US010808306B2

(12) United States Patent
Chiba et al.

(10) Patent No.: US 10,808,306 B2
(45) Date of Patent: Oct. 20, 2020

(54) METHOD OF PRODUCING CO—NI-BASED ALLOY

(71) Applicants: Akihiko Chiba, Miyagi (JP); Takuma Otomo, Miyagi (JP); Yasunori Akasaka, Chiba (JP); Tomoo Kobayashi, Chiba (JP); Ryo Sugawara, Chiba (JP)

(72) Inventors: Akihiko Chiba, Miyagi (JP); Takuma Otomo, Miyagi (JP); Yasunori Akasaka, Chiba (JP); Tomoo Kobayashi, Chiba (JP); Ryo Sugawara, Chiba (JP)

(73) Assignees: SEIKO INSTRUMENTS INC., Chiba (JP); TOHOKU UNIVERSITY, Miyagi (JP)

( * ) Notice: Subject to any disclaimer, the term of this patent is extended or adjusted under 35 U.S.C. 154(b) by 717 days.

(21) Appl. No.: 14/966,817

(22) Filed: Dec. 11, 2015

(65) Prior Publication Data

US 2016/0097115 A1 Apr. 7, 2016

Related U.S. Application Data

(62) Division of application No. 13/231,539, filed on Sep. 13, 2011, now abandoned.

(30) Foreign Application Priority Data

Sep. 16, 2010 (JP) ..... 2010-208401

(51) Int. Cl.
*C22F 1/10* (2006.01)
*C22F 1/16* (2006.01)
(Continued)

(52) U.S. Cl.
CPC ..... *C22F 1/10* (2013.01); *B22D 7/005* (2013.01); *C21D 1/26* (2013.01); *C22C 1/02* (2013.01);
(Continued)

(58) Field of Classification Search
CPC ..... C22F 1/10; C22F 1/11; C22F 1/16; C22C 1/023; C22C 19/055; C22C 19/056; C22C 19/07; C22C 27/06; C22C 30/00
See application file for complete search history.

(56) References Cited

U.S. PATENT DOCUMENTS 3,767,385 A * 10/1973 Slaney ..... C22C 19/07 148/442
3,811,872 A 5/1974 Snape
(Continued)

FOREIGN PATENT DOCUMENTS

JP 60-187652 9/1985
JP 08-311587 11/1996
(Continued)

OTHER PUBLICATIONS

"Glossary of Metallurgical and Metalworking Terms," Metals Handbook, ASM Handbooks Online, ASM International, 2002, pp. 1, 8, 9, 33, 34, 45, 46, 126, 189, 190, 257. (Year: 2002).*
(Continued)

*Primary Examiner* — Vanessa T. Luk
(74) *Attorney, Agent, or Firm* — Brinks Gilson & Lione

(57) ABSTRACT

Provided is a Co—Ni-based alloy in which a crystal is easily controlled, a method of controlling a crystal of a Co—Ni-based alloy, a method of producing a Co—Ni-based alloy, and a Co—Ni-based alloy having controlled crystallinity. The Co—Ni-based alloy includes Co, Ni, Cr, and Mo, in which the Co—Ni-based alloy has a crystal texture in which a Goss orientation is a main orientation. The Co—Ni-based
(Continued)

EXTENDED DISLOCATION INDUCED BY SUZUKI EFFECT alloy preferably has a composition including, in terms of mass ratio: 28 to 42% of Co, 10 to 27% of Cr, 3 to 12% of Mo, 15 to 40% of Ni, 0.1 to 1% of Ti, 1.5% or less of Mn, 0.1 to 26% of Fe, 0.1% or less of C, and an inevitable impurity; and at least one kind selected from the group consisting of 3% or less of Nb, 5% or less of W, 0.5% or less of Al, 0.1% or less of Zr, and 0.01% or less of B.

6 Claims, 17 Drawing Sheets

(51) Int. Cl.

| | |
|---|---|
| ***C22C 19/05*** | (2006.01) |
| ***C22C 19/07*** | (2006.01) |
| ***C22C 30/00*** | (2006.01) |
| ***C22C 1/02*** | (2006.01) |
| ***C22C 19/00*** | (2006.01) |
| ***H01F 1/147*** | (2006.01) |
| ***C22C 19/03*** | (2006.01) |
| ***B22D 7/00*** | (2006.01) |
| ***C21D 1/26*** | (2006.01) |

(52) U.S. Cl.

CPC ..... *C22C 1/023* (2013.01); *C22C 19/00* (2013.01); *C22C 19/03* (2013.01); *C22C 19/055* (2013.01); *C22C 19/056* (2013.01); *C22C 19/07* (2013.01); *C22C 30/00* (2013.01); *C22F 1/16* (2013.01); *H01F 1/147* (2013.01); *C21D 2211/008* (2013.01)

(56) References Cited

U.S. PATENT DOCUMENTS

| | | | |
|---|---|---|---|
| 3,816,106 | A | 6/1974 | Snape |
| 4,877,461 | A | 10/1989 | Smith |
| 2004/0025989 | A1 | 2/2004 | Chiba |
| 2004/0033158 | A1 | 2/2004 | Chiba |
| 2005/0016645 | A1 | 1/2005 | Takahashi |
| 2008/0166258 | A1 | 7/2008 | Tanimoto |
| 2010/0048322 | A1 | 2/2010 | Sugawara |

FOREIGN PATENT DOCUMENTS

| | | | | |
|---|---|---|---|---|
| JP | 09013136 | A | * | 1/1997 |
| JP | 10-140279 | | | 5/1998 |
| JP | 2006037206 | A | * | 2/2006 |

OTHER PUBLICATIONS

"Glossary of Metallurgical and Metalworking Terms," Metals Handbook, ASM Handbooks Online, ASM International, 2002, pp. 1, 104, 105, 196, 257. (Year: 2002).*

* cited by examiner

EXTENDED DISLOCATION INDUCED BY SUZUKI EFFECT

| Component | | h | k | l | u | v | w | $\phi_1$ | $\phi$ | $\phi_2$ |
|---|---|---|---|---|---|---|---|---|---|---|
| Goss | G | 1 | 1 | 0 | 0 | 0 | 1 | 90.0 | 90.0 | 45 |
| Brass | B | 1 | 1 | 0 | 1 | −1 | 2 | 54.7 | 90.0 | 45 |
| Copper twin | Ct | 5 | 5 | 2 | 1 | 1 | 5 | 90.0 | 74.2 | 45 |
| Copper | C | 1 | 1 | 2 | −1 | −1 | 1 | 90.0 | 35.3 | 45 |
| Dillamore | D | 4 | 4 | 11 | −11 | 11 | 8 | 90.0 | 27.2 | 45 |

METHOD OF PRODUCING CO—NI-BASED ALLOY

RELATED APPLICATIONS

This application claims is a divisional of U.S. patent application Ser. No. 13/231,539 filed Sep. 13, 2011, which claims priority to Japanese Patent Application No. 2010-208401 filed on Sep. 16, 2010; the entire contents of each are incorporated by reference.

BACKGROUND OF THE INVENTION

1. Field of the Invention

The present invention relates to a Co—Ni-based alloy, a method of controlling a crystal of a Co—Ni-based alloy, a method of producing a Co—Ni-based alloy, and a Co—Ni-based alloy having controlled crystallinity.

2. Description of the Related Art

There have been conventionally known a Co-based alloy, an Ni-based alloy, and the like as an elastic material having high mechanical strength and having superior corrosion resistance (see, for example, Japanese Patent Application Laid-open No. Sho 60-187652). However, as progress has been made in the reduction in size of devices and the diversification of environment in which the devices are used, an elastic alloy having better characteristics has been demanded.

There are known, as a technique for increasing the strength of a material at the time of producing a Co-based alloy, an Ni-based alloy, or stainless steel, a method of forming a working-induced martensite phase by carrying out cold plastic work, a method of precipitating a γ' phase such as a (Co, Ni)3(Al, Ti, Nb), a method of precipitating a carbide, a method of precipitating an intermetallic compound, and the like.

In order to improve the workability and other characteristics of metal materials such a Co-based alloy and an Ni-based alloy, it is known that carrying out crystal control of the metal materials is an effective way. However, the crystal control of the metal materials is very difficult work to carry out, because consideration must be taken on many parameters such as the change of a crystal texture, in addition to the change of a heat treatment temperature and a heat treatment time.

SUMMARY OF THE INVENTION

The present invention has been made in view of the conventional actual circumstances described above, and has an object to provide a Co—Ni-based alloy in which a crystal is easily controlled, a method of controlling a crystal of a Co—Ni-based alloy, a method of producing a Co—Ni-based alloy, and a Co—Ni-based alloy having controlled crystallinity.

The present invention has adopted the following constitution in order to solve the above-mentioned problem.

A Co—Ni-based alloy according to a first aspect of the present invention includes Co, Ni, Cr, and Mo, in which the Co—Ni-based alloy has a crystal texture in which a Goss orientation is a main orientation.

A Co—Ni-based alloy according to a second aspect of the present invention includes Co, Ni, Cr, and Mo, in which the Co—Ni-based alloy has a fine region and a deformation twin, the deformation twin being separated by the fine region.

A Co—Ni-based alloy according to a third aspect of the present invention includes Co, Ni, Cr, and Mo, in which the Co—Ni-based alloy has a dislocation density of $10^{15}$ $m^{-2}$ or more.

The Co—Ni-based alloy according to a fourth aspect of the present invention preferably has a composition including, in terms of mass ratio: 28 to 42% of Co, 10 to 27% of Cr, 3 to 12% of Mo, 15 to 40% of Ni, 0.1 to 1% of Ti, 1.5% or less of Mn, 0.1 to 26% of Fe, 0.1% or less of C, and an inevitable impurity; and at least one kind selected from the group consisting of 3% or less of Nb, 5% or less of W, 0.5% or less of Al, 0.1% or less of Zr, and 0.01% or less of B.

The Co—Ni-based alloy according to a fifth aspect of the present invention preferably has a crystal texture in which a Goss orientation accounts for 35 to 55% of all orientations.

The Co—Ni-based alloy of the present invention is preferably produced by performing cold rolling at a reduction ratio of 15% or more.

In the Co—Ni-based alloy of the present invention, a main orientation of the crystal texture after heat treatment is also preferably identical to a main orientation of the crystal texture before heat treatment.

In the Co—Ni-based alloy of the present invention, a crystal texture is also preferably converted to a texture in which a plurality of regions each having a low dislocation density are present in a region having a high dislocation density, by performing heat treatment.

A method of controlling a crystal of a Co—Ni-based alloy according to the present invention includes: producing the Co—Ni-based alloy according to any one of the first to fifth aspects of the present invention by performing cold rolling at a reduction ratio of 15% or more to an alloy including Co, Ni, Cr, and Mo; and applying heat treatment to the Co—Ni-based alloy, thereby converting a texture of the Co—Ni-based alloy to a texture in which a plurality of regions each having a low dislocation density are present in a region having a high dislocation density so that a main orientation of a crystal texture after the heat treatment is identical to a main orientation of a crystal texture before the heat treatment.

In the method of controlling a crystal of a Co—Ni-based alloy according to the present invention, the Co—Ni-based alloy preferably has a crystal texture in which a Goss orientation is a main orientation.

In the method of controlling a crystal of a Co—Ni-based alloy according to the present invention, the applying of the heat treatment is preferably performed at temperature of 350° C. or more.

In the method of controlling a crystal of a Co—Ni-based alloy according to the present invention, the applying of the heat treatment may also be performed at temperature of 350° C. to 750° C.

A method of producing a Co—Ni-based alloy having controlled crystallinity according to the present invention includes using the above-mentioned method of controlling a crystal of a Co—Ni-based alloy.

The present invention also provides a Co—Ni-based alloy having controlled crystallinity, which is produced by using the above-mentioned method of controlling a crystal of a Co—Ni-based alloy.

Even if the Co—Ni-based alloy of the present invention is subjected to heat treatment, the main orientation of its crystal texture does not change. Thus, when the crystal of the alloy is controlled, it is not necessary to consider the change of its crystal texture, and it is enough to consider only the parameters of a heat treatment temperature and time, and hence the crystal of the alloy can be easily controlled.

Therefore, the present invention can provide a Co—Ni-based alloy having high mechanical strength, having excellent corrosion resistance, and being excellent as an elastic material.

In the method of controlling a crystal of a Co—Ni-based alloy according to the present invention, the Suzuki effect is expressed by performing heat treatment to a Co—Ni-based alloy. As a result, the Co—Ni-based alloy is recrystallized so as to have a texture in which a plurality of regions in which dislocations are extended and locked owing to the Suzuki effect, thereby having a low dislocation density are present in a region having a high dislocation density. Such dislocation locking due to the Suzuki effect as described above delays dislocation recovery, and hence the main orientation of the crystal texture can remain unchanged. Therefore, the method of controlling a crystal of a Co—Ni-based alloy can provide a Co—Ni-based alloy which is not softened rapidly even if thermal history such as annealing is applied, has a high recrystallization temperature, and includes recrystallized grains each having a small diameter.

In the Co—Ni-based alloy obtained by the method of controlling a crystal of a Co—Ni-based alloy according to the present invention, the main orientation of the crystal texture is identical to the main orientation of the crystal texture before heat treatment, which indicates that crystals are controlled.

Further, in the Co—Ni-based alloy obtained by the method of controlling a crystal of a Co—Ni-based alloy according to the present invention, recrystallized grains grow slowly, and hence the Co—Ni-based alloy is formed by fine recrystallized grains. As a result, there is provided a Co—Ni-based alloy in which characteristics such as workability are improved. Besides, in the method of controlling a crystal of a Co—Ni-based alloy according to the present invention, the Suzuki effect is expressed by heat treatment, thereby causing dislocation locking, resulting in resisting slip. Thus, it is possible to produce a Co—Ni-based alloy excellent in mechanical characteristics such as hardness and tensile strength.

DETAILED DESCRIPTION OF THE PREFERRED EMBODIMENTS

Figure 1A:
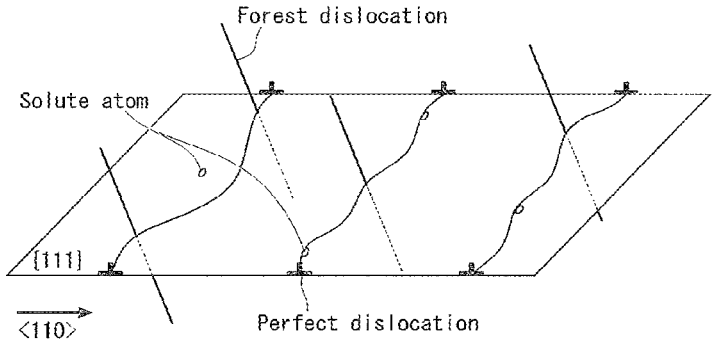
FIG. 1A is a schematic view illustrating dislocations pinned by solute atoms and by dislocations of different slip planes.

A Co—Ni-based alloy according to this embodiment includes Co, Ni, Cr, and Mo, in which the Co—Ni-based alloy has a crystal texture in which a Goss orientation {110} <001> (hereinafter, simply referred to as Goss orientation) is a main orientation. The crystal texture of the Co—Ni-based alloy according to this embodiment mainly includes, as orientation factors, in addition to the Goss orientation, a Brass orientation {110} <112> (hereinafter, simply referred to as Brass orientation) and a Copper orientation {211} <111> (hereinafter, simply referred to as Copper orientation).

The main orientation of a crystal texture can be decided by determining the orientations of crystal grains based on three stereographic projection views such as (111), (001), and (110). For example, by comparing the peak intensity of each orientation in the pole figure of the crystal texture (111), the orientation that exhibits the highest peak intensity can be determined as the main orientation of the crystal texture. Further, in order to determine the main orientation of the crystal texture more quantitatively, 3-D crystal orientation distribution functions (ODFs) are calculated based on the pole figures of the crystal textures (111), (001), and (110), the components of the crystal textures having angles $\varphi_1$, $\varphi$, and $\varphi_2$ are determined by a Bunge method, the intensities of the components of a rolling texture expressed at $\varphi_2=45°$ are compared, and the component having the highest intensity can be determined as the main orientation of the crystal texture.

In the Co—Ni-based alloy according to this embodiment, the Goss orientation preferably accounts for 35 to 55% of all orientation factors.

The Co—Ni-based alloy according to this embodiment is preferably subjected to cold rolling at a reduction ratio of 15% or more, and is more preferably subjected to cold rolling at a reduction ratio of 15 to 90%. When the Co—Ni-based alloy is subjected to cold rolling at a reduction ratio of 15% or more, the Co—Ni-based alloy can have a Goss orientation as the main orientation of its crystal texture. Further, when the Co—Ni-based alloy is subjected to cold rolling at a reduction ratio of more than 90%, a Brass orientation sometimes develops, and hence the reduction ratio is preferably controlled to 90% or less.

The Co—Ni-based alloy according to this embodiment preferably has a composition including, in terms of mass ratio: 28 to 42% of Co, 10 to 27% of Cr, 3 to 12% of Mo, 15 to 40% of Ni, 0.1 to 1% of Ti, 1.5% or less of Mn, 0.1 to 26% of Fe, 0.1% or less of C, and an inevitable impurity; and at least one kind selected from the group consisting of 3% or less of Nb, 5% or less of W, 0.5% or less of Al, 0.1% or less of Zr, and 0.01% or less of B. The reason why the composition is limited to such range is described below.

Co per se has a large work-hardening capability, and hence Co has a reducing effect on the fragility of edge cutting, an increasing effect on the fatigue strength, and an increasing effect on the high-temperature strength. However, if the content of Co is less than 28%, those effects are weakly exhibited. If the content of Co is more than 42% in this composition, a matrix becomes too hard, with the result that working on the alloy becomes difficult and a face-centered cubic lattice phase becomes unstable with respect to a hexagonal close-packed lattice phase. Thus, the content of Co was set to 28 to 42%.

Cr is an essential component for ensuring the corrosion resistance and has a reinforcing effect on a matrix. However, if the content of Cr is less than 10%, the effect of imparting excellent corrosion resistance is weakly exhibited. If the content of Cr is more than 27%, the workability on and toughness of the alloy sharply lower. Thus, the content of Cr was set to 10 to 27%.

Mo has a reinforcing effect on a matrix by forming a solid solution with the matrix, an increasing effect on the work-hardening capability, and an enhancing effect on the corrosion resistance in the coexistence with Cr. However, if the content of Mo is less than 3%, desired effects are not provided. If the content of Mo is more than 12%, the workability sharply lowers and a fragile a phase is apt to be generated. Thus, the content of Mo was set to 3 to 12%.

Ni has a stabilizing effect on a face-centered cubic lattice phase, a maintaining effect on the workability, and an enhancing effect on the corrosion resistance. However, in the composition ranges of Co, Cr, Mo, Nb, and Fe in the alloy of the present invention, if the content of Ni is less than 15%, providing a stabilized face-centered cubic lattice phase is difficult. If the content of Ni is more than 40%, the mechanical strength lowers. Thus, the content of Ni was set to 15 to 40%.

Ti has strong effects of deoxidation, denitrification, and desulfurization, and has a miniaturizing effect on an ingot texture. However, if the content of Ti is less than 0.1%, those effects are weakly exhibited. If the content is, for example, 1%, no problem occurs. If the content of Ti is too large, the amount of inclusions increases in the alloy, or an $\eta$ phase ($Ni_3Ti$) is precipitated, resulting in a reduction in toughness. Thus, the content of Ti was set to 0.1 to 1%.

Mn has the effects of deoxidation and desulfurization, and a stabilizing effect on a face-centered cubic lattice phase. However, if the content of Mn is too large, the corrosion resistance and the oxidation resistance deteriorate. Thus, the content of Mn was set to 1.5% or less.

If the content of Fe is too large, the oxidation resistance lowers. However, priority was given to the reinforcing effect on a matrix by forming a solid solution with the matrix rather than the oxidation resistance, and hence the upper limit of the content of Fe was set to 26%. Thus, the content of Fe was set to 0.1 to 26%.

C forms a solid solution with a matrix and, in addition, has a preventing effect on grain coarsening by forming carbides with Cr, Mo, Nb, W, or the like. However, if the content of C is too large, for example, the toughness lowers and the corrosion resistance deteriorates. Thus, the content of C was set to 0.1% or less.

Nb has a reinforcing effect on a matrix by forming a solid solution with the matrix and an increasing effect on the work-hardening capability. However, if the content of Nb is more than 3.0%, a $\sigma$ phase or a $\delta$ phase ($Ni_3Nb$) is precipitated, resulting in a reduction in toughness. Thus, the content of Nb, if any, was set to 3% or less.

W has a reinforcing effect on a matrix by forming a solid solution with the matrix and a significant increasing effect on the work-hardening capability. However, if the content of W is more than 5%, a $\sigma$ phase is precipitated, resulting in a reduction in toughness. Thus, the content of W, if any, was set to 5% or less.

Al has the effect of deoxidation and an enhancing effect on the oxidation resistance. However, if the content of Al is too large, the corrosion resistance deteriorates, for example. Thus, the content of Al, if any, was set to 0.5% or less.

Zr has an enhancing effect on the hot workability by increasing the strength of a crystal grain boundary at high temperatures. However, if the content of Zr is too large, the workability deteriorates in reverse. Thus, the content of Zr, if any, was set to 0.1% or less.

B has an improving effect on the hot workability. However, if the content of B is too large, the hot workability lowers in reverse, resulting in easy break of the alloy. Thus, the content of B, if any, was set to 0.01% or less.

Further, the Co—Ni-based alloy according to this embodiment more preferably includes 0.1 to 3% of Fe and 3% or less of Nb selected as the at least one kind. That is, more preferred is a Co—Ni-based alloy having a composition including, in terms of mass ratio, 28 to 42% of Co, 10 to 27% of Cr, 3 to 12% of Mo, 15 to 40% of Ni, 0.1 to 1% of Ti, 1.5% or less of Mn, 0.1 to 3% of Fe, 0.1% or less of C, 3% or less of Nb, and an inevitable impurity. In the Co—Ni-based alloy having the composition described above, by setting the upper limit of Fe to 3%, the oxidation resistance can be prevented from lowering more effectively.

If a face-centered cubic lattice (fcc) alloy undergoes some processing, a Brass orientation usually develops in the crystal texture of the alloy rather than a Goss orientation. Further, it is known that the recrystallization of the alloy after heat treatment generally results in the change of its crystal texture. Thus, the change of the crystal texture described above made it difficult to control the crystals of the alloy. In the Co—Ni-based alloy according to this embodiment, when a deformation texture is recrystallized, the recrystallized texture probably has a certain orientation in its core, and hence the main orientation of its crystal texture is maintained. Thus, when the crystals of the alloy are controlled, it is not necessary to consider the change of the crystal texture, and it is enough to consider only the parameters of a heat treatment temperature and time, and hence the crystals of the alloy can easily be controlled.

The reason why the main orientation of the crystal texture of the Co—Ni-based alloy according to this embodiment does not change by heat treatment is that the Co—Ni-based alloy according to this embodiment is an alloy which expresses the Suzuki effect by undergoing heat treatment.

The Suzuki effect is one of the interactions between a dislocation and a solute atom. Dislocations in a face-centered cubic lattice (fcc) alloy and a hexagonal close-packed lattice (hcp) alloy are extended dislocations in many cases, and hence an extended dislocation portion has a different energy state to a certain extent from a surrounding portion, and solute atoms are segregated in the extended dislocation portion. When dislocations move to this portion, a segregated portion, which is thermally non-equilibrated, remains and a non-segregated portion occurs at the same time. Both portions newly produce a portion having large energy, resulting in resisting a dislocation motion. Its locking force has nearly the same level as an elastic interaction. However, as the extended dislocation portion is large, it becomes more difficult for the dislocation to be released from the locking. The interaction between a dislocation and a solute atom is generally called a chemical interaction or the Suzuki effect. The expression of the Suzuki effect contributes to improving mechanical characteristics such as the hardness and tensile strength of an alloy.

As illustrated in FIG. 1A, when dislocations are locally pinned by solute atoms and by dislocations of different slip planes, the dislocations do not slip easily because of the pinning, but the dislocations may project between pinned portions and the dislocations are not locked very strongly.

Figure 1B:
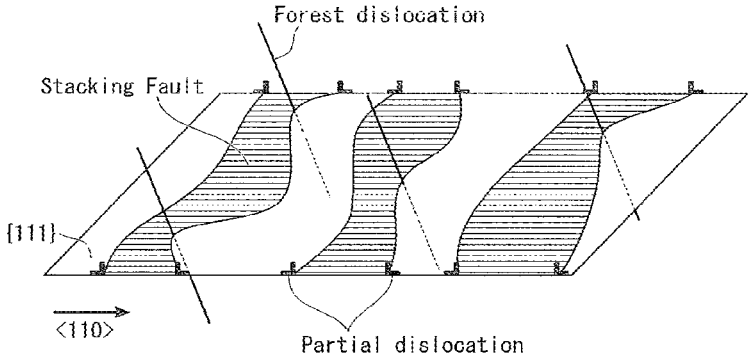
FIG. 1B is a schematic view illustrating how dislocations are locked like a plane because of the extension of the dislocations due to the Suzuki effect.

On the other hand, when the Suzuki effect is expressed in the Co—Ni-based alloy according to this embodiment, as illustrated in FIG. 1B, dislocations are extended and are continuously locked like a plane not like a dot as in the pinning. Thus, the dislocations cannot project and are locked strongly. The continuous locking of dislocations as described above provides the effect of improving the strength of the alloy, and in addition, prevents easy slip of dislocations and delays dislocation recovery, leading to the stability of the texture of the alloy.

The inventors of the present invention have made various studies. As a result, the inventors have found that the Suzuki effect can be expressed in the Co—Ni-based alloy according to this embodiment, and have found that a Co—Ni-based alloy having excellent characteristics can be provided by taking advantage of the Suzuki effect.

Figure 2A:
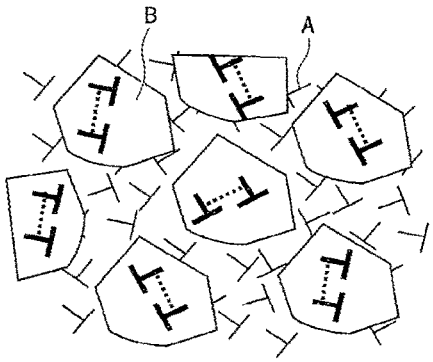
FIG. 2A is a schematic view illustrating how a Co—Ni-based alloy according to this embodiment is recrystallized by heat treatment.

When the Suzuki effect is expressed owing to heat treatment in the Co—Ni-based alloy according to this embodiment, as illustrated in FIG. 2A, formed in the alloy is a texture in which, in region A having a high dislocation density (high-density dislocation region), there exist a plurality of regions B each having a low dislocation density (low-density dislocation regions) in which extended dislocations are induced by the Suzuki effect, forming a state in which the dislocations do not recover. In the low-density dislocation region B in which dislocations are extended owing to the Suzuki effect, forming a state in which the dislocations do not easily recover, the dislocations recover slowly, and hence recrystallized grains grow slowly. Dislocations are not extended in the high dislocation density region A, and hence this region serves as a grain core for developing recrystallization, but the plurality of low-density dislocation regions B contribute to preventing the rapid progress of grain growth, thereby forming fine recrystallized grains. Further, in the regions B in which dislocations are extended owing to the Suzuki effect and the dislocations recover slowly, even if recrystallization develops, recrystallized grains grow while the crystal texture of the regions B is maintained. Thus, in the Co—Ni-based alloy according to this embodiment, the main orientation of the crystal texture before heat treatment can remain the same even after recrystallization is caused by the heat treatment.

Figure 2B:
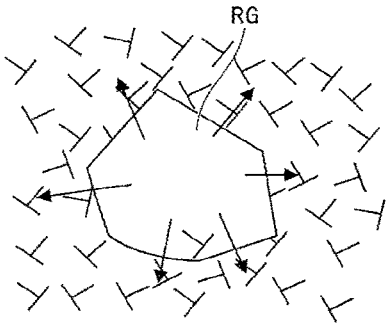
FIG. 2B is a schematic view illustrating how a general alloy is recrystallized by heat treatment.

On the other hand, in an alloy in which the Suzuki effect is not expressed, heat treatment causes the climb motion of dislocations and promotes the growth of recrystallized grains, and recrystallization causes the crystal texture to change. In the case where the Suzuki effect is not expressed, as illustrated in FIG. 2B, a recrystallized grain RG keeps growing before coming into contact with an adjacent recrystallized grain, and hence a large recrystallized grain with a diameter of about 10 μm is formed.

Figure 6:
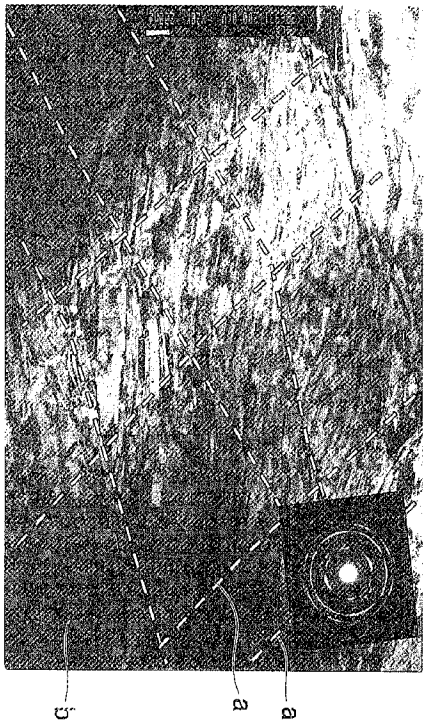
FIG. 6 is a TEM bright-field image photograph of the Co—Ni-based alloy in Example 1.
Figure 7:
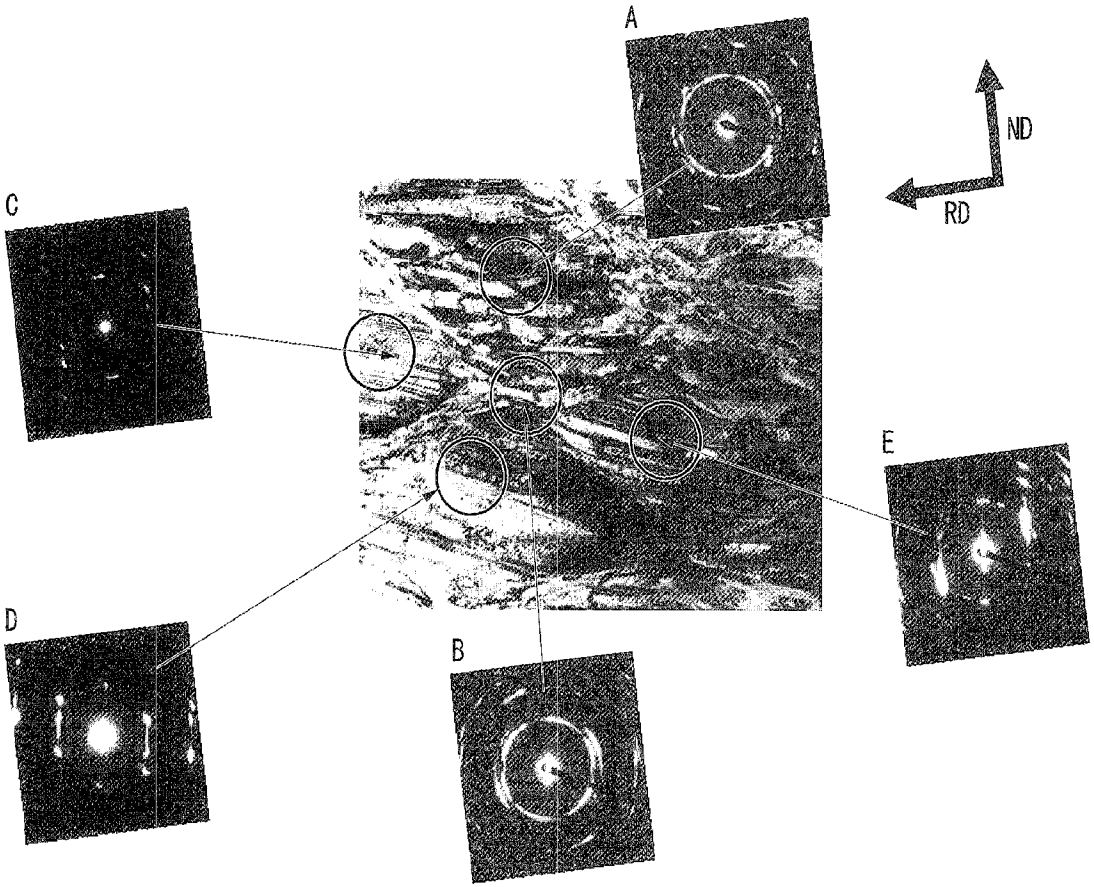
FIG. 7 includes partially magnified photographs of the TEM bright-field image photograph shown in FIG. 6.

It is preferred that the Co—Ni-based alloy according to this embodiment include Co, Ni, Cr, and Mo, have fine regions a and deformation twins b, and have a crystal texture in which the deformation twins b are separated by the fine regions a. FIG. 6 shows a transmission electron microscope (TEM) bright-field image photograph of the crystal texture of a Co—Ni-based alloy sample obtained in an example described below. FIG. 7 shows TEM bright-field image photographs taken by partially magnifying the crystal texture shown in FIG. 6. Note that the Co—Ni-based alloy shown in FIG. 6 and FIG. 7 is formed by applying cold rolling at a reduction ratio of 70%. In regions A and B in FIG. 7, each diffraction pattern shows a ring shape, and hence it is found that these regions are polycrystalline fine regions a having various orientations. On the other hand, in regions C and D looking like lines in FIG. 7, each diffraction pattern shows that diffraction spots have a dot shape or regularity. Thus, it is found that the region is formed of deformation twins b having the same orientation in view of the positional relationship between the diffraction spots. The Co—Ni-based alloy according to this embodiment has, as shown in the wide view photograph of FIG. 6, a crystal texture in which deformation twins b looking like lines are separated like a grid by fine regions a represented by broken lines.

The Co—Ni-based alloy according to this embodiment has, as shown in FIG. 6 and FIG. 7 deformation twins b separated like a grid, the deformation twins being very fine deformation twins compared with those of general binary alloys such as a Co-35Ni alloy. The fact that such very fine deformation twins are preferentially formed and large shear bands are not formed, thereby delaying the development of a Brass orientation, is also probably a cause for a Goss orientation to be maintained. That is, the regions represented by broken lines in FIG. 6 and the regions A and B in FIG. 7 are, as described previously, fine regions a, and, as these regions are regions each having a very high dislocation density, heat treatment converts the regions to high-density dislocation regions A, and these regions diversify as fine grain cores for recrystallization. Further, it is estimated that, in the deformation twins b separated by these fine regions a, dislocations are extended and locked owing to the Suzuki effect, dislocations recover slowly, and hence the Goss orientation is maintained as the main orientation.

Further, the Co—Ni-based alloy according to this embodiment has a feature that its dislocation density is $10^{15}$ $m^{-2}$ or more. General alloys each have a dislocation density of about $10^{10}$ to $10^{12}$ $m^{-2}$ after usual heat treatment, and have a dislocation density of about $10^{12}$ to $10^{14}$ $m^{-2}$ even after cold rolling processing is performed. The Co—Ni-based alloy according to this embodiment has a relatively high dislocation density compared with dislocation densities of general alloys, and moreover, the Co—Ni-based alloy has such polycrystalline fine regions and fine deformation twins as described above. Thus, dislocations are formed in the Co—Ni-based alloy more easily than in general alloys, probably resulting in its higher dislocation density.

Figure 14A:
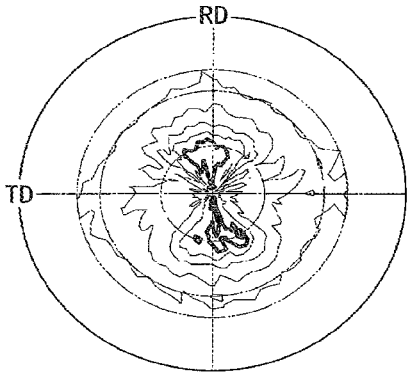
FIG. 14A is a pole figure of a crystal texture (111) before heat treatment of an alloy in Example 4.
Figure 14B:
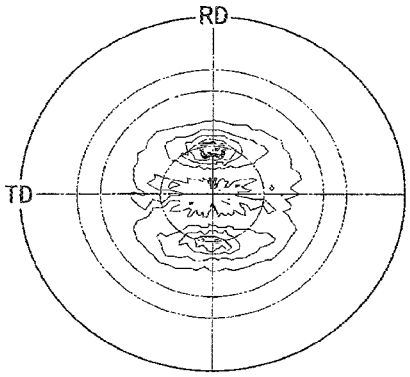
FIG. 14B is a pole figure of the crystal texture (111) after heat treatment of the alloy in Example 4.

Even if the Co—Ni-based alloy according to this embodiment is subjected to heat treatment, the main orientation of its crystal texture does not change. Thus, when the crystals of the alloy are controlled, it is not necessary to consider the change of its crystal texture, and it is enough to consider only the parameters of a heat treatment temperature and time, and hence the crystals of the alloy can be easily controlled. FIG. 14A illustrates a pole figure of the crystal texture (111) of the Co—Ni-based alloy (a cold rolling reduction ratio of 90%) according to this embodiment. FIG. 14B illustrates a pole figure of the crystal texture (111) of the Co—Ni-based alloy having been subjected to heat treatment at 1,050° C. for 1 hour. As illustrated in FIG. 14A and FIG. 14B, even after the Co—Ni-based alloy according to this embodiment is subjected to heat treatment at 1,050° C. for 1 hour, peaks in the pole figure of the crystal texture (111) almost remain unchanged, and a Goss orientation is the main orientation in the crystal texture after the heat treatment. Thus, it is found that the main orientation of the crystal texture before the heat treatment was maintained. It is found from this result that, even if the Co—Ni-based alloy according to this embodiment is subjected to heat treatment at 1,050° C., the main orientation of its crystal texture is maintained, and hence the crystals of the Co—Ni-based alloy can be easily controlled, providing an excellent Co—Ni-based alloy.

Next, described is a method of producing a Co—Ni-based alloy in which the method of controlling a crystal of a Co—Ni-based alloy according to this embodiment is used.

First, an alloy including the composition described above is subjected to vacuum melting in a vacuum melting furnace, followed by furnace cooling to produce an ingot. The resultant ingot is subjected to hot forging by a general method, followed by annealing. Next, cold rolling is performed at a reduction ratio of 15% or more, thereby producing the Co—Ni-based alloy according to this embodiment. Here, by performing cold rolling at a reduction ratio of 15% or more, it is possible to obtain a Co—Ni-based alloy having a Goss orientation as the main orientation of its crystal texture. Further, if cold rolling is performed at a reduction ratio of more than 90%, a Brass orientation tends to develop easily, and hence cold rolling is preferably performed at a reduction ratio of 90% or less. Note that the crystal texture of the present invention is not formed after hot forging and annealing.

Next, the produced Co—Ni-based alloy is subjected to heat treatment. Heat treatment conditions can be altered arbitrarily. Heat treatment is preferably performed at temperature of 350° C. or more because the Suzuki effect is expressed, thereby extending and locking dislocations, the recovery of the dislocations is delayed, the main orientation of the crystal texture of the Co—Ni-based alloy remains unchanged, and hence a Goss orientation can be still maintained as the main orientation after the heat treatment. Further, as the Suzuki effect is expressed in the early stage of heating, the upper limit of heat treatment temperature is not particularly limited. The main orientation of the crystal texture can remain unchanged even at as high a temperature as, for example, about 1,050° C., but recrystallization is apt to be more dominant at 800° C. or more than dislocation locking induced by the Suzuki effect. Thus, the temperature of the heat treatment is more preferably in the range of 350° C. to 750° C. When the heat treatment is performed in the temperature range described above, the Suzuki effect can be effectively expressed, thereby allowing the main orientation of the crystal texture to remain unchanged. Further, the time of the heat treatment can be altered arbitrarily depending on the temperature of the heat treatment, and is set to preferably 0.5 hour or more and 3.5 hours or less, more preferably 0.5 hour or more and 1.5 hours or less.

By conducting the above-mentioned processes, a Co—Ni-based alloy can be produced while the crystals of the Co—Ni-based alloy are being controlled. When the method of controlling a crystal of a Co—Ni-based alloy according to this embodiment is adopted, heat treatment does not change the main orientation of the crystal texture of the alloy, and hence it becomes possible to control the crystals of the alloy by performing the heat treatment while considering only the temperature and time of the heat treatment.

When the method of controlling a crystal of a Co—Ni-based alloy according to this embodiment is adopted, the Suzuki effect is expressed by performing heat treatment, thereby, as illustrated in FIG. 2A, causing the crystal texture of the Co—Ni-based alloy to recrystallize as a texture in which a plurality of regions B each having a low dislocation density are present in a region A having a high dislocation density. As a result, the main orientation of the crystal texture can remain unchanged.

Figure 19A:
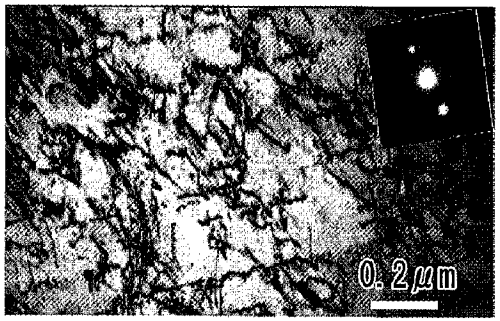
FIG. 19A is a TEM bright-field image photograph of the alloy before heat treatment in Example 6.
Figure 19B:
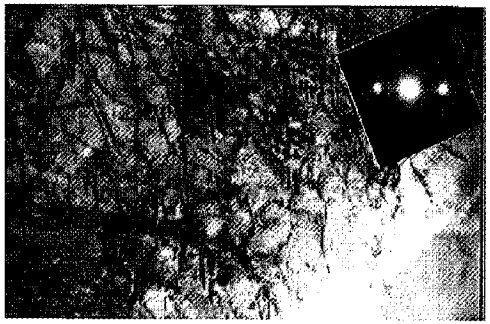
FIG. 19B is a TEM bright-field image photograph of the alloy after heat treatment in Example 6.

FIG. 19A shows a TEM bright-field image photograph of a Co—Ni-based alloy (a reduction ratio of 15%) having a component composition including 31 mass % of Ni, 19 mass % of Cr, 10.1 mass % of Mo, 2 mass % of Fe, 0.8 mass % of Ti, 1 mass % of Nb, and Co accounting for the balance, as one Example of the Co—Ni-based alloy according to this embodiment. FIG. 19B shows a photograph of the crystal texture of the above-mentioned Co—Ni-based alloy to which heat treatment was applied at 700° C. for 1 hour. The heat treatment causes many stacking faults that look like small vertical lines to occur as shown in FIG. 19B, and it is found that the Suzuki effect has contributed to extending and locking dislocations.

Figure 19C:
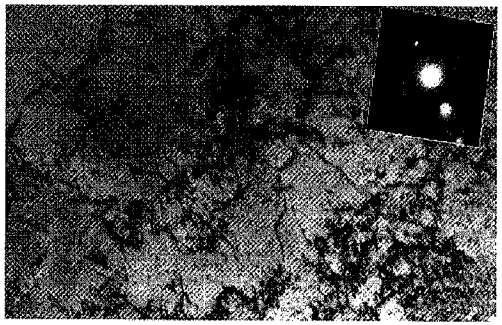
FIG. 19C is a TEM bright-field image photograph of the alloy before heat treatment in Comparative Example 6.
Figure 19D:
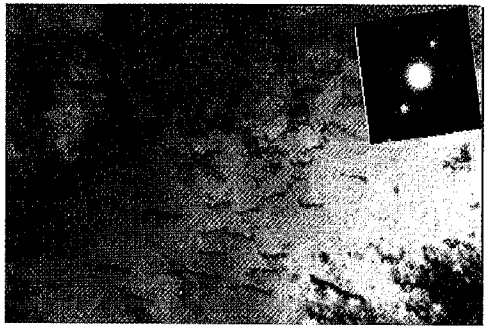
FIG. 19D is a TEM bright-field image photograph of the alloy after heat treatment in Comparative Example 6.

FIG. 19C shows a TEM bright-field image photograph of a Co-35Ni alloy (a reduction ratio of 15%). FIG. 19D shows a TEM bright-field image photograph of the above-mentioned Co-35Ni alloy to which heat treatment was applied at 350° C. for 1 hour. As shown in FIG. 19D, in the Co-35Ni alloy, dislocations that look like lines are decreased by performing the heat treatment, indicating the recovery of the dislocations.

Figure 17A:
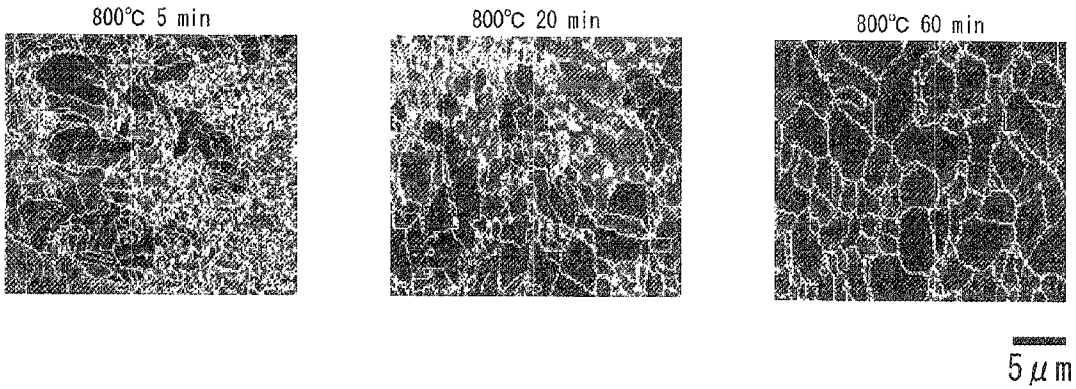
FIG. 17A includes photographs showing measurement results of KAM images by EBSD of the alloy in Example 5 for respective heat treatment times, and FIG. 17B includes photographs showing measurement results of KAM images by EBSD of the alloy in Comparative Example 5 for respective heat treatment times.
Figure 17B:
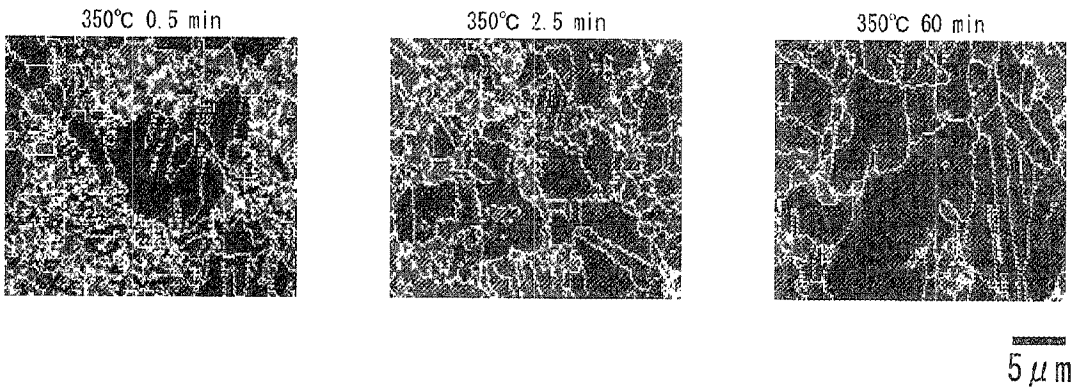

FIG. 17A shows electron backscatter diffraction (EBSD) images of the Co—Ni-based alloy (a reduction ratio of 70%) according to this embodiment to which alloy heat treatment was applied at 800° C. for treatment times of 5 minutes, 20 minutes, and 60 minutes, respectively. As shown in FIG. 17A, in the Co—Ni-based alloy according to this embodiment, recrystallization and grain growth progressed slowly, the diameter of each of recrystallized grains changed only slightly by changing the heat treatment time, and even though heat treatment at 800° C. for 60 minutes was performed, the diameter of each of the recrystallized grains was about 2 μm. In contrast, as shown in FIG. 17B, it is found that, in the Co-35Ni alloy (a reduction ratio of 70%) in a comparative example, heat treatment at 350° C. for 60 minutes causes recrystallization and the resultant recrystallized grains are large. From these results, it is estimated that, as shown in FIG. 2A, in the Co—Ni-based alloy according to this embodiment, heat treatment contributed to forming a texture in which a plurality of regions B each having a low dislocation density are present in a region A having a high dislocation density, and hence, even though recrystallized grains grew, the diameter of each of the recrystallized grains was kept small.

In the Co—Ni-based alloy obtained by adopting the method of controlling a crystal of a Co—Ni-based alloy according to this embodiment, the main orientation of its crystal texture is identical to the main orientation of the crystal texture before heat treatment, which indicates that crystals are controlled.

Further, as shown in FIG. 17A, in the Co—Ni-based alloy obtained by adopting the method of controlling a crystal of a Co—Ni-based alloy according to this embodiment, recrystallized grains grow slowly, and hence the Co—Ni-based alloy is formed by fine recrystallized grains. As a result, there is provided a Co—Ni-based alloy in which characteristics such as workability are improved. Besides, by adopting the method of controlling a crystal of a Co—Ni-based alloy according to this embodiment, the Suzuki effect is expressed by heat treatment, thereby inducing the locking of dislocations, resulting in preventing easy slip of the dislocations. Thus, it is possible to produce a Co—Ni-based alloy excellent in mechanical characteristics such as hardness and tensile strength.

EXAMPLES

Hereinafter, the present invention is described in more detail with reference to examples. However, the present invention is not limited to the following examples.

[X-ray Diffraction]

X-ray diffraction measurement was carried out using an X-ray diffractometer "monochromator" manufactured by Koninklijke Philips Electronics N.V.

[Electron Backscatter Diffraction (EBSD; Electron Backscatter Diffraction Method)]

Measurement was carried out with a TSL-01M manufactured by AMETEK Co., Ltd.

[Transmission Electron Microscope (TEM) Observation]

Measurement was carried out with a 2000EX manufactured by JEOL Ltd.

[Hardness Value [HV]]

Measurement was carried out with an HMV manufactured by SHIMADZU CORPORATION.

[0.2% Proof Stress, Ultimate Tensile Strength (UTS), and Elongation]

Measurement was carried out with a DSS-10T manufactured by SHIMADZU CORPORATION.

[RD//E and TD//E]

Measurement was carried out with a modulus measurement device "JE-RT" manufactured by Nihon Techno-Plus Co., Ltd.

[Dislocation Density]

A dislocation density was calculated by using a modified Warren-Averbach method (J. Phys. Chem. Sol., 62, 2001, 1935-1941) which was established by introducing a contrast factor C (constant for crystal face dependence of strain sensitivity) to the Warren-Averbach method proposed by T. Unger.

The X-ray diffraction profile of each sample is measured, and the background is subtracted from the raw profile. After that, measurement error factors are corrected, the Fourier transform is performed, and a Fourier coefficient A(L) corresponding to a Fourier length (L) is obtained from each diffraction profile. Then, the dislocation density and attribute parameter of the texture can be calculated by using the Warren-Averbach calculating formulae represented by the Equation (1) to Equation (3) described below.

[Math. 1]

$$\ln A(L) \cong \ln A^S(L) - \frac{\pi b^2}{2}\rho L^2 \ln\left(\frac{R_e}{L}\right)(K^2\overline{C}) + O(K^2\overline{C})^2 \quad \text{Equation (1)}$$

$$X(L) = -\left(\frac{\pi b^2}{2}\right)\rho L^2 \ln\left(\frac{R_e}{L}\right) \quad \text{Equation (2)}$$

$$\frac{X(L)}{L^2} = -\rho\left(\frac{\pi b^2}{2}\right)\ln R_e + \rho\left(\frac{\pi b^2}{2}\right)\ln L \quad \text{Equation (3)}$$

In Equation (1) to Equation (3), b represents a Burgers vector, $R_e$ represents the size of a strain field caused by dislocation, p represents a dislocation density, K=2 sin θ/λ, O represents a constant based on a distance between dislocations, $A^s(L)$ represents a Fourier coefficient based on a crystal grain diameter, and L represents a distance satisfying a coherent diffraction condition (Fourier length).

As Equation (2) shows, X(L) is a coefficient of a linear term of Equation (1), and Equation (2) can be modified to Equation (3). Thus, by plotting $X(L)/L^2$ with respect to 1 nL, the dislocation density p can be determined. Note that, in this example, an X-ray diffractometer "monochromator" manufactured by Koninklijke Philips Electronics N.V. was used to measure an X-ray diffraction profile, and Origin (manufactured by OriginLab Corporation) was used as analysis software.

[Crystallite Size]

A crystallite size was calculated by using the Scherrer formula represented by crystallite size=Kλ/(β cos θ). Here, K represents a Scherrer constant, λ, represents the wavelength of an X-ray used, β represents the half-value width of an X-ray diffraction peak, and θ represents an X-ray incident angle 2θ. Note that the crystallite size refers to the size of a subgrain.

Figure 3:
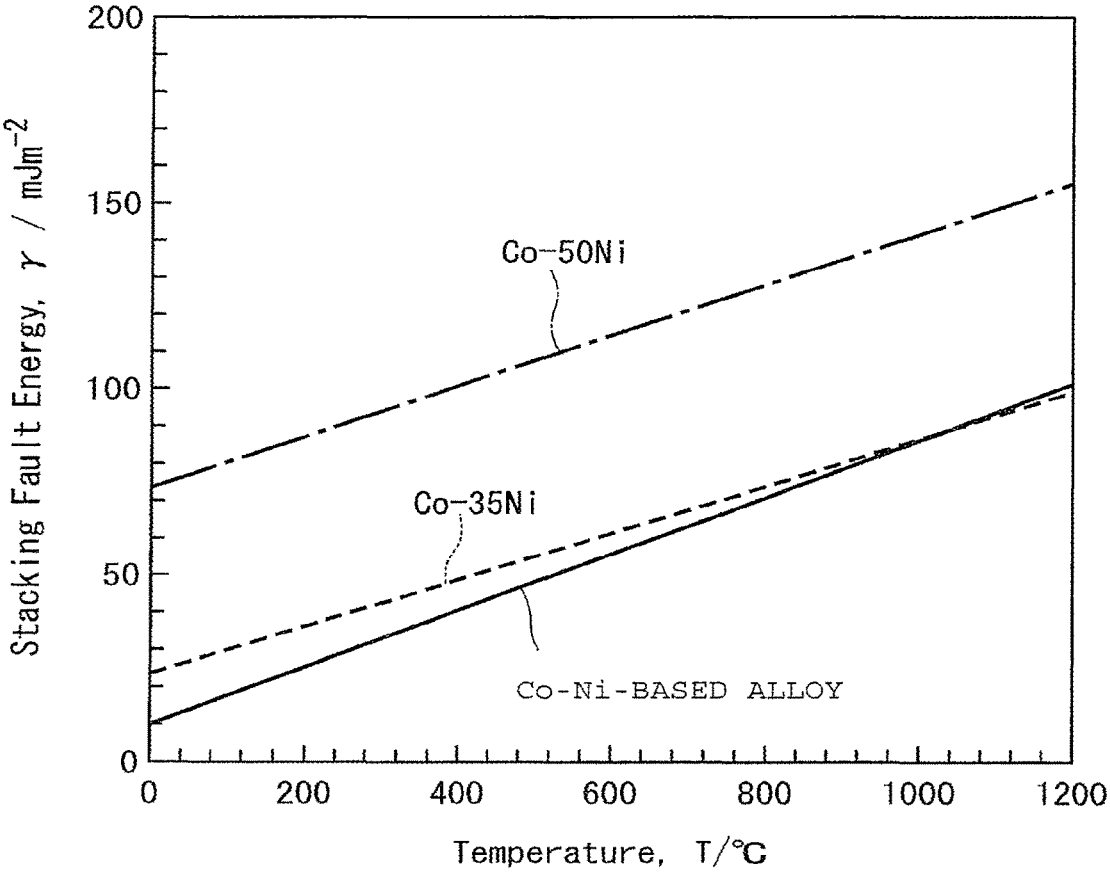
FIG. 3 is a graph illustrating temperature dependence of stacking fault energy of the Co—Ni-based alloy according to this embodiment and a Co—Ni alloy.

In the following examples, SUS316L and a Co-35Ni alloy, which were widely used alloys, were used for comparison. The Co-35Ni alloy has, as illustrated in FIG. 3, nearly the same stacking fault energy at around room temperature as the Co—Ni-based alloy in this example. Further, because both have nearly the same temperature dependence of stacking fault energy, the Co-35Ni alloy was chosen as a comparative material. Here, FIG. 3 illustrates the stacking fault energy (SFE) of alloy systems, the energy being necessary for causing phase transformation from a γ phase, which has a face-centered cubic lattice (fcc) structure, to an ε phase, which has a hexagonal close-packed lattice (hcp) structure. A method of thermodynamically calculating SFE is described in Mater. Sci. Eng. A 387-389 (2004) 158-162, and the stacking fault energy $\gamma_{SFE}$ can be calculated based on Equation (4) and Equation (5) described below.

[Math. 2]

$$\gamma_{SFE} = 2\rho\Delta G^{\gamma\to\varepsilon} + 2\sigma^{\gamma/\varepsilon} \quad \text{Equation (4)}$$

$$\rho = \frac{4}{\sqrt{3}}\frac{1}{a^2 N} \quad \text{Equation (5)}$$

Here, $\Delta G^{\gamma\to\varepsilon}$ represents a Gibbs energy change associated with γ→ε transformation, $\sigma^{\gamma/\varepsilon}$ represents the interface energy of a γ/ε boundary, a represents the lattice constant (=0.354 nm) of an fcc phase, and N represents Avogadro's number (=$6.022\times10^{23}$ $mol^{-1}$). Used for $\Delta G^{\gamma\to\varepsilon}$ was a value calculated by using Thermo-Calc (manufactured by Thermo-Calc Software: ver. 4.1.3.41, database: FE ver. 6). Further, the temperature dependence of the interface energy in Equation (4) is small and the value of the temperature dependence is constant in transition metal irrespective of temperature. Thus, in this example, $2\sigma^{\gamma/\varepsilon}$=15 $mJm^{-2}$, which is a surface energy term, was used to make a calculation.

In the examples shown below, a high-frequency vacuum induction melting furnace was used to blend and melt the following each element, with a component composition of 31 mass % of Ni, 19 mass % of Cr, 10.1 mass % of Mo, 2 mass % of Fe, 0.8 mass % of Ti, 1 mass % of Nb, and Co accounting for the balance, followed by furnace cooling. The resultant ingot was subjected to hot forging and then subjected to annealing at 1,050° C., providing an alloy material (hereinafter, referred to as "alloy material for examples"), which was used to produce each Co—Ni-based alloy.

On the other hand, in comparative examples, a high-frequency vacuum induction melting furnace was used to blend and melt the following each element, with a component composition of 35 mass % of Ni and Co accounting for the balance, followed by furnace cooling. The resultant ingot was subjected to hot forging and then subjected to annealing at 1,000° C., providing an alloy material (hereinafter, referred to as "alloy material for comparative examples"), which was used to produce each Co-35Ni alloy.

Note that heat treatment in the following examples and comparative examples was performed in a vacuum at a temperature rise speed of 8° C./second, and at a cooling speed of 12° C./second.

Example 1

A Co—Ni-based alloy was produced by applying cold rolling to the alloy material for examples at a reduction ratio of 70%.

Comparative Example 1

A Co-35Ni alloy was produced by applying cold rolling to the alloy material for comparative examples at a reduction ratio of 70%.

Comparative Example 2

A Co-35Ni alloy was produced by applying cold rolling to the alloy material for comparative examples at a reduction ratio of 50%.

Figure 4A:
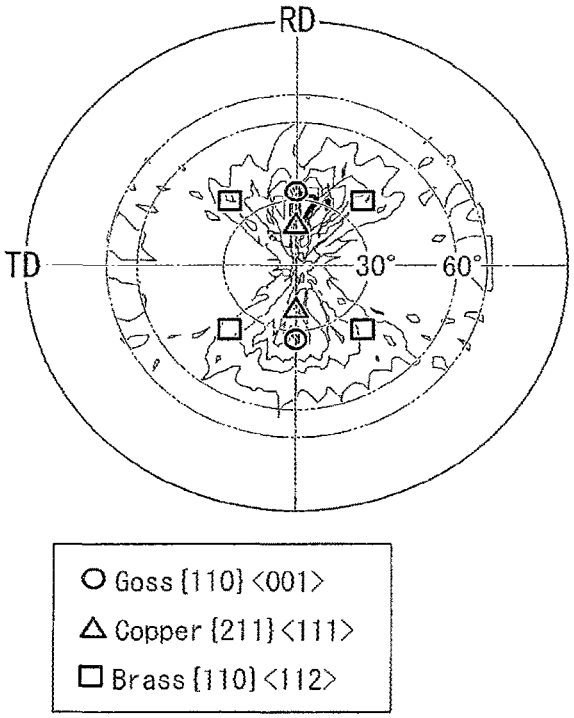
FIG. 4A is a pole figure of a rolling texture (111) of a Co—Ni-based alloy in Example 1.
Figure 4B:
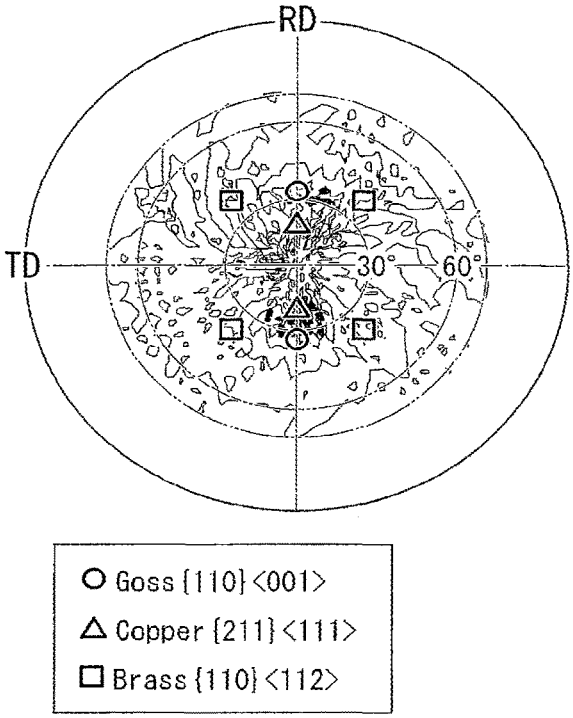
FIG. 4B is a pole figure of a rolling texture (111) of a Co-35Ni alloy in Comparative Example 1.
Figure 5A:
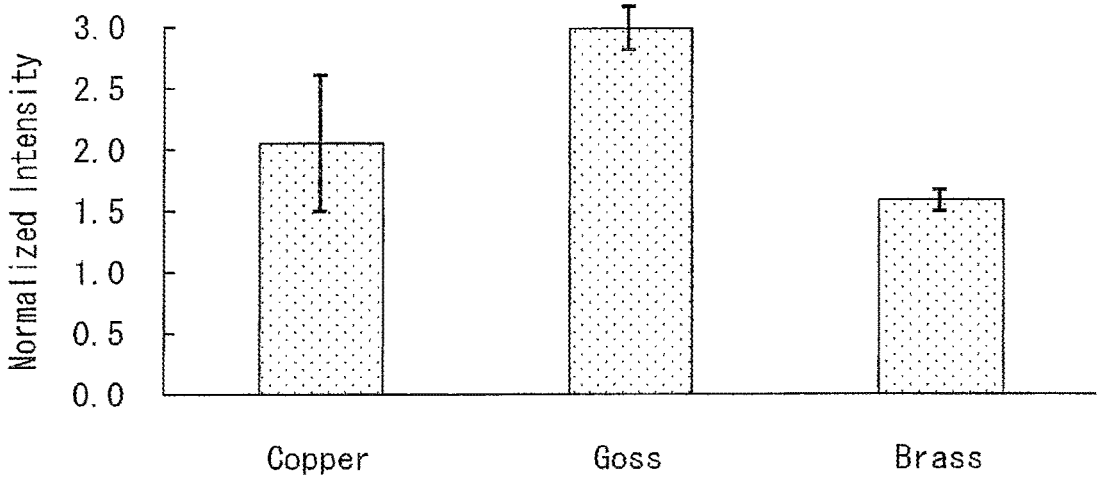
FIG. 5A is a graph prepared by plotting the peak intensity of each of a Goss orientation, a Copper orientation, and a Brass orientation in the pole figure illustrated in FIG. 4A.
Figure 5B:
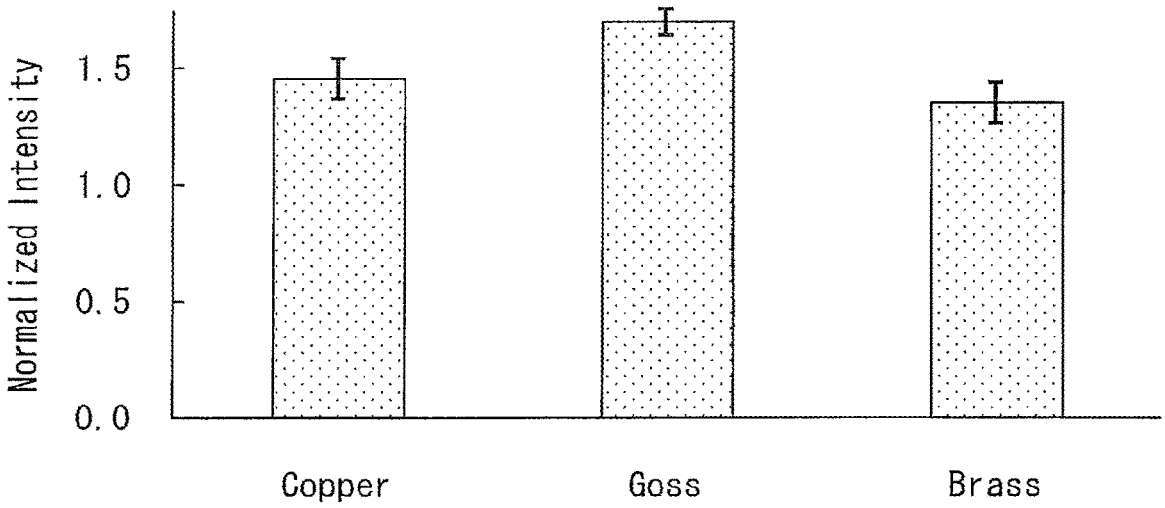
FIG. 5B is a graph prepared by plotting the peak intensity of each of a Goss orientation, a Copper orientation, and a Brass orientation in the pole figure illustrated in FIG. 4B.

X-ray diffraction measurement was carried out on each of the alloys in Example 1 and Comparative Example 1. FIG. 4A is a pole figure of the rolling texture (111) of the Co—Ni-based alloy in Example 1, and FIG. 4B is a pole figure of the rolling texture (111) of the Co-35Ni alloy in Comparative Example 1. Further, FIG. 5A is a graph prepared by plotting the peak intensity of each of a Goss orientation, a Copper orientation, and a Brass orientation in the pole figure illustrated in FIG. 4A, and FIG. 5B is a graph prepared by plotting the peak intensity of each of a Goss orientation, a Copper orientation, and a Brass orientation in the pole figure illustrated in FIG. 4B. In the Co—Ni-based alloy in Example 1 and the Co-35Ni alloy in Comparative Example 1, it was found from FIGS. 4A and 4B that Goss {110} <001> was present in the rolling direction RD, and it was also found from the peak intensity ratio of each orientation in FIGS. 5A and 5B that their crystal textures had the Goss orientation as the main orientation.

Next, the crystal texture of each of the alloys in Example 1, and Comparative Examples 1 and 2 was observed with a transmission electron microscope (TEM). FIG. 6 is a TEM bright-field image photograph of the Co—Ni-based alloy in Example 1, and FIG. 7 includes magnified photographs of the TEM bright-field image photograph of FIG. 6. In the regions A and B in FIG. 7, each diffraction pattern shows a ring shape, and hence it is found that these regions are polycrystalline fine regions having various orientations. On the other hand, in the regions C and D shown in FIG. 7 looking like lines, each diffraction pattern shows that diffraction spots have a dot shape or regularity. Thus, it is found that the regions are formed of deformation twins having the same orientation in view of the positional relationship between the diffraction spots. In the Co—Ni-based alloy in Example 1, as shown in the wide view photograph of FIG. 6, deformation twins b looking like lines were separated like a grid by fine regions a represented by broken lines.

Figure 8:
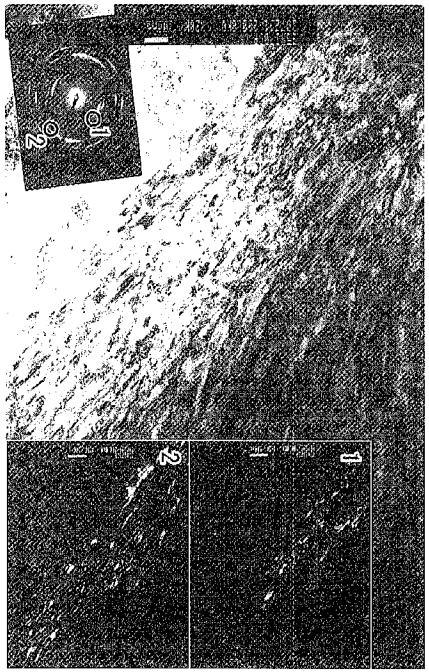
FIG. 8 includes TEM bright-field image photographs of the Co-35Ni alloy in Comparative Example 1.
Figure 9:
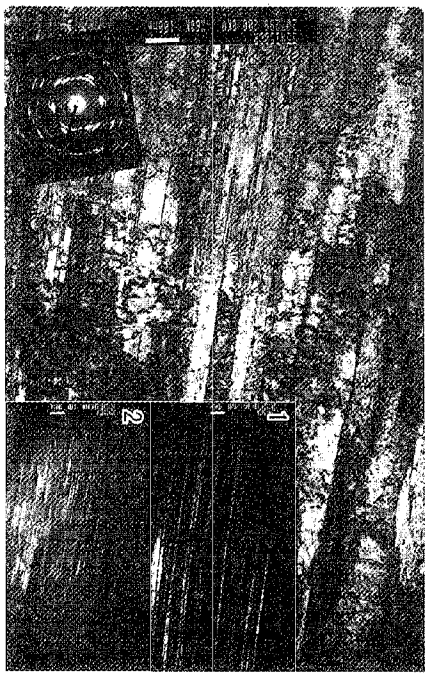
FIG. 9 includes TEM bright-field image photographs of a Co-35Ni alloy in Comparative Example 2.

FIG. 8 includes TEM bright-field image photographs of the Co-35Ni alloy in Comparative Example 1, and FIG. 9 includes TEM bright-field image photographs of the Co-35Ni alloy in Comparative Example 2. As shown in FIG. 8 and FIG. 9, the crystal texture of the Co-35Ni alloy in each of Comparative Examples 1 and 2 was a texture including large deformation twins having a wide band shape, and such deformation twins separated like a grid as found in the Co—Ni-based alloy in Example 1 were not found.

Example 2

Sample Nos. 1 to 7

Figure 10:
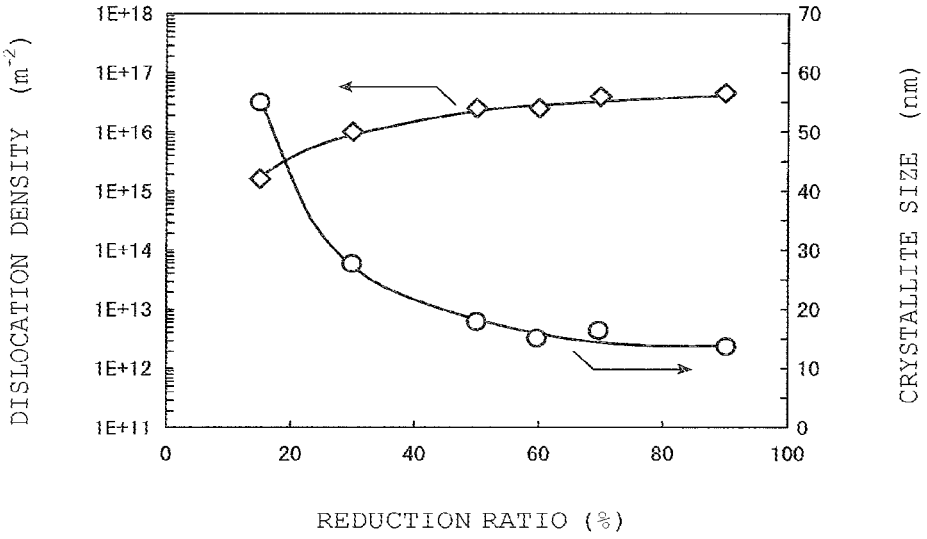
FIG. 10 is a graph prepared by plotting a relationship between the dislocation density and crystallite of the Co—Ni-based alloy for each cold rolling reduction ratio.

Cold rolling was applied to the alloy material for examples at each reduction ratio listed in Table 1, thereby producing each Co—Ni-based alloy of Sample Nos. 1 to 7. X-ray diffraction measurement and texture observation were carried out on the resultant each Co—Ni-based alloy to determine the dislocation density and crystallite size. The resultant results were also listed in Table 1. Also listed in Table was Sample No. 0, which refers to an alloy material for examples to which cold rolling was not applied (a reduction ratio of 0%). Note that in Table 1, determination by EBSD (electron backscatter diffraction) was made based on the criteria in which observable cases were each represented by Symbol "○" and unobservable cases were each represented by Symbol "x." Further, FIG. 10 illustrates a graph prepared by plotting a relationship between the dislocation density and crystallite of the Co—Ni-based alloy for each cold rolling reduction ratio. Note that, in FIG. 10, the circular symbols each represents a point plotted for a crystallite size and the rhombic symbols each represents a point plotted for a dislocation density.

TABLE 1

| | | XRD data | | | | Texture observation | | |
|---|---|---|---|---|---|---|---|---|
| Sample No. | Reduction ratio | Crystal structure | Dislocation density [$m^{-2}$] | Crystallite [nm] | Crystal texture | TEM | EBSD | Optical microscope |
| 0 | 0% | γ | — | — | Absent | — | — | — |
| 1 | 15% | γ | $1.68 \times 10^{15}$ | 55.0 | Goss | Planar dislocation texture | ○ | Crystal grains extending in RD |
| 2 | 30% | γ | $1.03 \times 10^{16}$ | 28.0 | Goss | — | ○ | — |
| 3 | 50% | γ | $2.60 \times 10^{16}$ | 18.0 | Goss | Deformation twins and deformation bands | ○ | — |
| 4 | 60% | γ | $2.60 \times 10^{16}$ | 15.0 | Goss | — | ○ | — |
| 5 | 70% | γ | $3.91 \times 10^{16}$ | 16.4 | Goss | Deformation twins and deformation bands | ○ | — |
| 6 | 90% | γ | $4.49 \times 10^{16}$ | 13.8 | Goss | Strain-induced crystal grain refinement | x | Crystal grains extending in RD |
| 7 | 98% | γ | — | — | Brass | — | — | — |

From the results in Table 1 and FIG. 10, it was confirmed that the Co—Ni-based alloys to which cold rolling was applied at a reduction ratio of 15% or more each had a dislocation density of $10^{15}$ $m^{-2}$ or more, and the Co—Ni-based alloys to which cold rolling was applied at a reduction ratio of 15 to 90% each had a crystal texture including a Goss orientation as the main orientation.

Figure 11A:
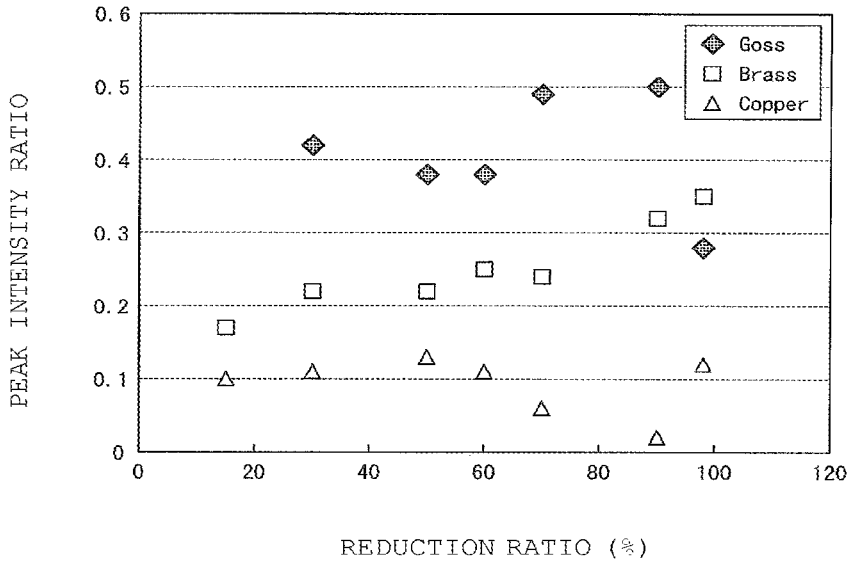
FIG. 11A is a graph illustrating the peak intensity ratio of each orientation component in the pole figure of the rolling texture (111) of the Co—Ni-based alloy for each cold rolling reduction ratio.
Figure 11B:
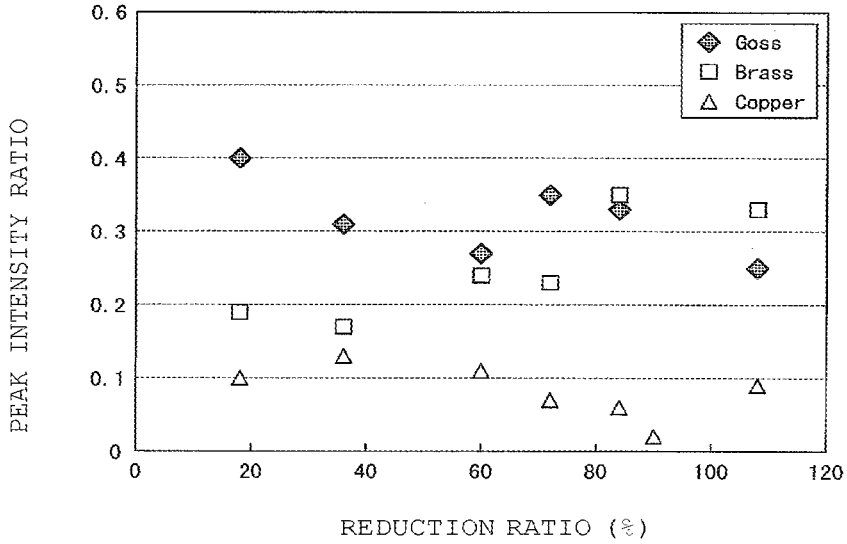
FIG. 11B is a graph illustrating the peak intensity ratio of each orientation component in the pole figure of the rolling texture (111) of the Co-35Ni alloy for each cold rolling reduction ratio.
Figure 12:
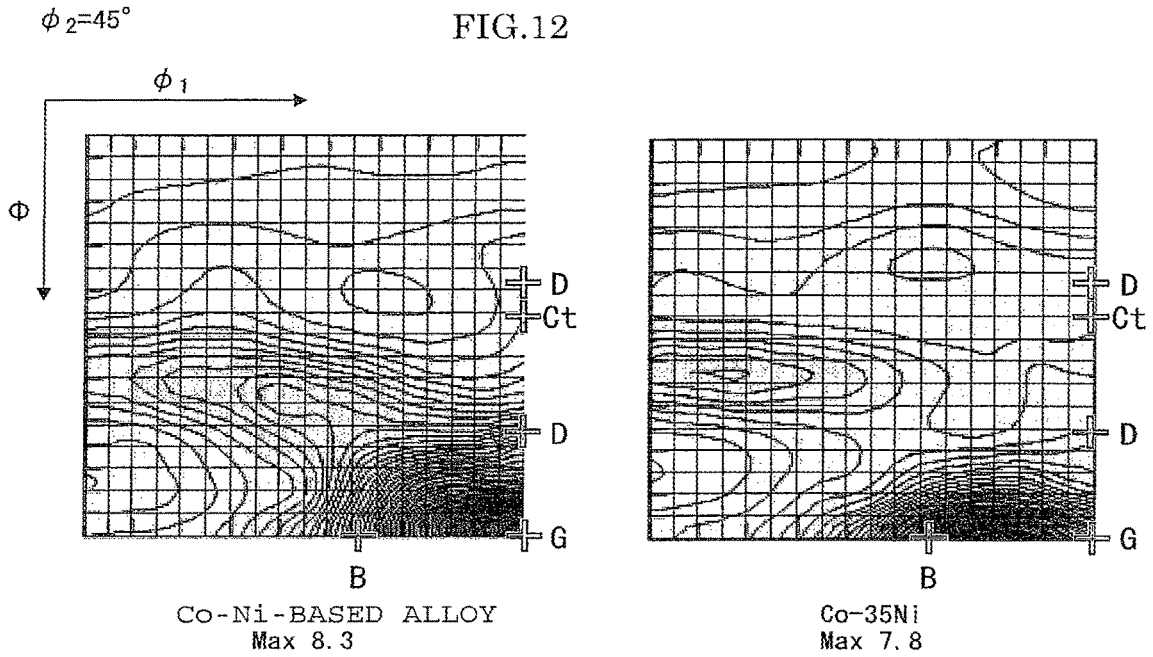
FIG. 12 includes ODF maps of a Co—Ni-based alloy processed at a reduction ratio of 70% and a Co-35Ni alloy processed at a reduction ratio of 70%.

Further, the Co—Ni-based alloys of No. 1 to No. 7 and Co-35Ni alloys to which cold rolling was applied by changing the reduction ratio from 15% up to 90% were used to measure the pole figures of the rolling textures (111), (001), and (110). Based on these pole figures, 3-D crystal orientation distribution functions (ODFs) were calculated, the components of the rolling textures having angles $\varphi_1$, $\varphi$, and $\varphi_2$ were determined by a Bunge method, the intensities of the components of a rolling texture expressed at $\varphi_2$=45° were compared, and the component having the highest intensity was determined as the main orientation of the rolling texture of each alloy. Table 2 shows the intensity ratio=(intensity of target component/sum of intensities of all components) of each rolling texture obtained from the ODF maps. As shown in Table 2, the Co—Ni-based alloys of No. 1 to No. 7 and the Co-35Ni alloys in comparative examples each included a Copper twin orientation and a Dillamore orientation, in addition to a Goss orientation, a Brass orientation, and a Copper orientation. FIGS. 11A and 11B each illustrate a graph prepared by plotting the peak intensity ratios of the Goss orientation, the Copper orientation, and the Brass orientation out of the various orientation components obtained. FIG. 11A illustrates the peak intensity ratio of each orientation component of the Co—Ni-based alloys of No. 1 to No. 7, and FIG. 11B illustrates the peak intensity ratio of each orientation component of the Co-35Ni alloys in comparative examples. From the results of FIG. 11A, it is found that the crystal texture of the Co—Ni-based alloy in Example 2 included the Goss orientation at a rate ranging from 35 to 55%. Further, FIG. 12 includes ODF maps of the Co—Ni-based alloy processed at a reduction ratio of 70% and the Co-35Ni alloy processed at a reduction ratio of 70%.

TABLE 2

| | | | ODF intensity ratio | | | | | |
|---|---|---|---|---|---|---|---|---|
| | Sample No. | Reduction ratio | Brass | Goss | Copper twin | Copper | Dillamore | Main orientation |
| Example | 1 | 15% | 0.17 | 0.49 | 0.13 | 0.10 | 0.11 | Goss |
| | 2 | 30% | 0.22 | 0.42 | 0.04 | 0.11 | 0.21 | Goss |
| | 3 | 50% | 0.22 | 0.38 | 0.11 | 0.13 | 0.16 | Goss |
| | 4 | 60% | 0.25 | 0.38 | 0.13 | 0.11 | 0.14 | Goss |
| | 5 | 70% | 0.24 | 0.49 | 0.16 | 0.06 | 0.06 | Goss |
| | 6 | 90% | 0.32 | 0.50 | 0.15 | 0.02 | 0.02 | Goss |
| | 7 | 98% | 0.35 | 0.28 | 0.13 | 0.12 | 0.12 | Brass |
| Comparative Example Co—35Ni | 1 | 15% | 0.19 | 0.40 | 0.14 | 0.10 | 0.08 | Goss |
| | 2 | 30% | 0.17 | 0.31 | 0.10 | 0.13 | 0.17 | Goss |
| | 3 | 50% | 0.24 | 0.27 | 0.11 | 0.11 | 0.10 | Goss |
| | 4 | 60% | 0.23 | 0.35 | 0.12 | 0.07 | 0.06 | Goss |

TABLE 2-continued

| Sample No. | Reduction ratio | ODF intensity ratio | | | | | Main orientation |
|---|---|---|---|---|---|---|---|
| | | Brass | Goss | Copper twin | Copper | Dillamore | |
| 5 | 70% | 0.35 | 0.33 | 0.08 | 0.06 | 0.06 | Brass |
| 6 | 90% | 0.33 | 0.25 | 0.07 | 0.09 | 0.06 | Brass |

Example 3

Figure 13:
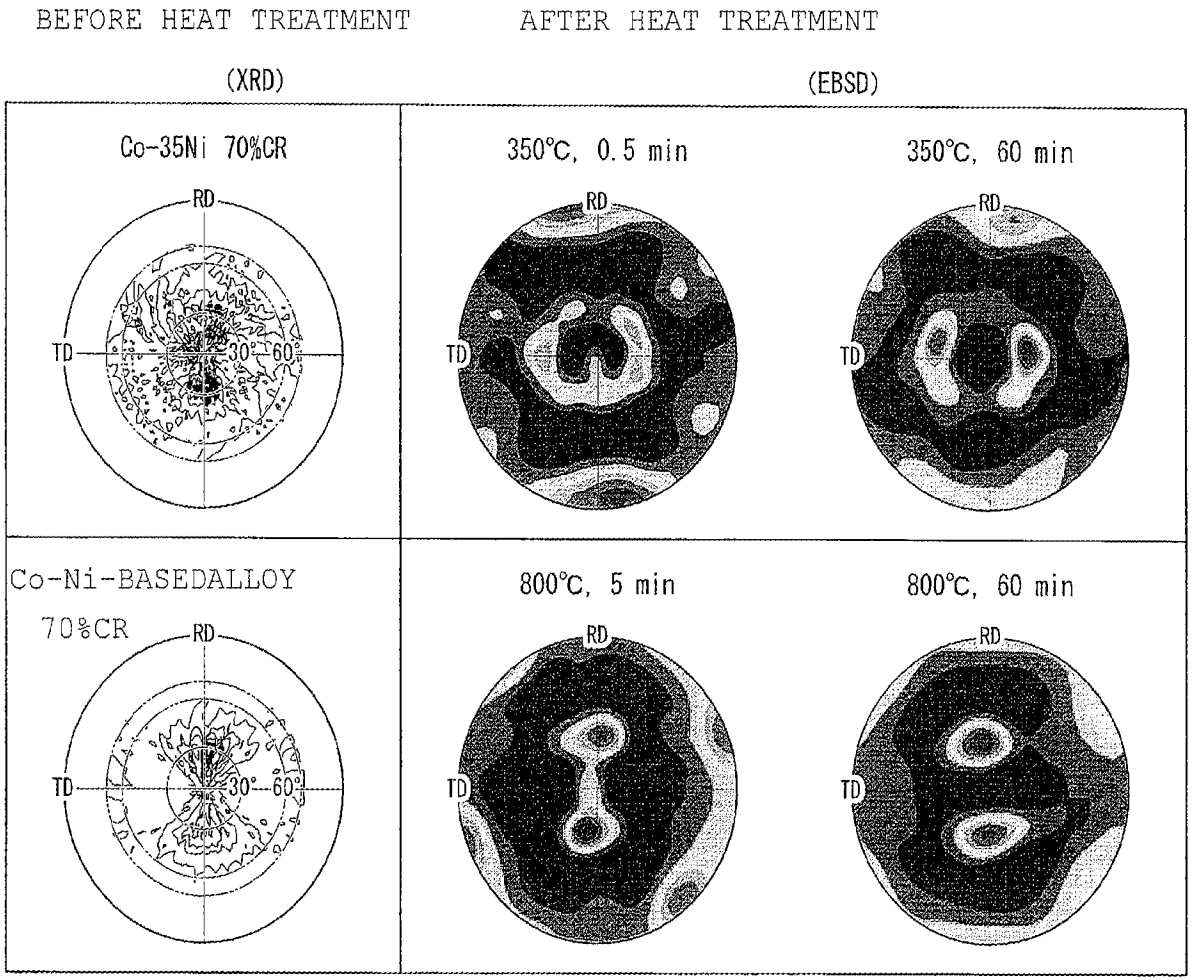
FIG. 13 includes measurement results by XRD or EBSD of a crystal texture before heat treatment and a crystal texture after heat treatment of an alloy in each of Example 3 and Comparative Example 3.

Cold rolling was applied to the alloy material for examples at a reduction ratio of 70%, thereby producing a Co—Ni-based alloy. Heat treatment at 800° C. was applied to the resultant Co—Ni-based alloy. FIG. 13 illustrates the EBSD result of the Co—Ni-based alloy to which heat treatment at 800° C. for 5 minutes was applied and the EBSD result of the Co—Ni-based alloy to which heat treatment at 800° C. for 60 minutes was applied, together with a (111) pole figure of the Co—Ni-based alloy before heat treatment. Consequently, as illustrated in FIG. 13, even though the Co—Ni-based alloy in Example 3 was subjected to the heat treatment at 800° C. for 60 minutes, there was no significant change between both EBSD peaks, and Goss {110} <001> was present in the rolling direction RD. Thus, the crystal texture of the Co—Ni-based alloy in Example 3 mainly included a Goss orientation after the heat treatment, indicating that the main orientation of the crystal texture before the heat treatment remained unchanged.

Comparative Example 3

Cold rolling was applied to the alloy material for comparative examples at a reduction ratio of 70%, thereby producing a Co-35Ni alloy. Heat treatment at 350° C. was applied to the resultant Co-35Ni alloy. FIG. 13 illustrates the EBSD result of the Co-35Ni alloy to which heat treatment at 350° C. for 5 minutes was applied and the EBSD result of the Co-35Ni alloy to which heat treatment at 350° C. for 60 minutes was applied, together with a (111) pole figure of the Co-35Ni alloy before heat treatment. Consequently, as illustrated in FIG. 13, by applying heat treatment at 350° C. to the Co-35Ni alloy in Comparative Example 3, the peak of Goss {110} <001> which had been present in the rolling direction RD disappeared, and a new peak appeared in the rolling width direction TD. Thus, heat treatment changed the main orientation of the crystal texture of the Co-35Ni alloy.

Example 4

Cold rolling was applied to the alloy material for examples at a reduction ratio of 90%, thereby producing a Co—Ni-based alloy. Heat treatment at 1,050° C. for 1 hour was applied to the resultant Co—Ni-based alloy. FIG. 14A is a (111) pole figure of the Co—Ni-based alloy before the heat treatment, and FIG. 14B is a (111) pole figure of the Co—Ni-based alloy after the heat treatment. As illustrated in FIG. 14A and FIG. 14B, even though the Co—Ni-based alloy in Example 4 was subjected to the heat treatment at 1,050° C. for 1 hour, there was no significant change between both peaks in the (111) pole figures, and Goss {110} <001> was present in the rolling direction RD. Thus, the crystal texture of the Co—Ni-based alloy in Example 4 mainly included a Goss orientation after the heat treatment, indicating that the main orientation of the crystal texture before the heat treatment remained unchanged.

Comparative Example 4

Figure 14C:
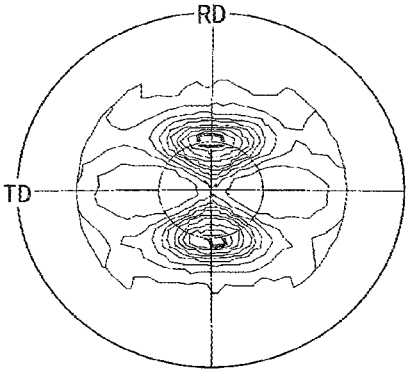
FIG. 14C is a pole figure of a crystal texture (111) before heat treatment of an alloy in Comparative Example 4.
Figure 14D:
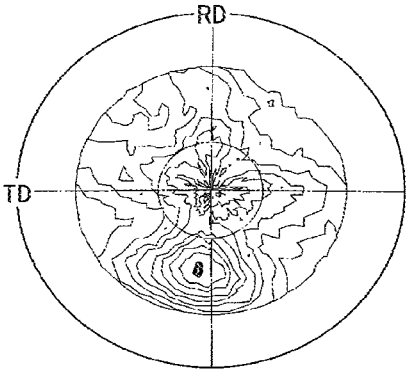
FIG. 14D is a pole figure of the crystal texture (111) after heat treatment of the alloy in Comparative Example 4.

Cold rolling was applied to SUS316L at a reduction ratio of 66%, thereby producing SUS316L-CR. Heat treatment at 1,050° C. for 1 hour was applied to the resultant SUS316L-CR. FIG. 14C is a (111) pole figure of the SUS316L-CR before the heat treatment, and FIG. 14D is a (111) pole figure of the SUS316L-CR after the heat treatment. As illustrated in FIG. 14C and FIG. 14D, by applying the heat treatment at 1,050° C. for 1 hour to the SUS316L, there was a remarkable change between the (111) pole figures. Thus, the main orientation of the crystal texture of the SUS316L was changed by performing the heat treatment.

Example 5

Figure 15:
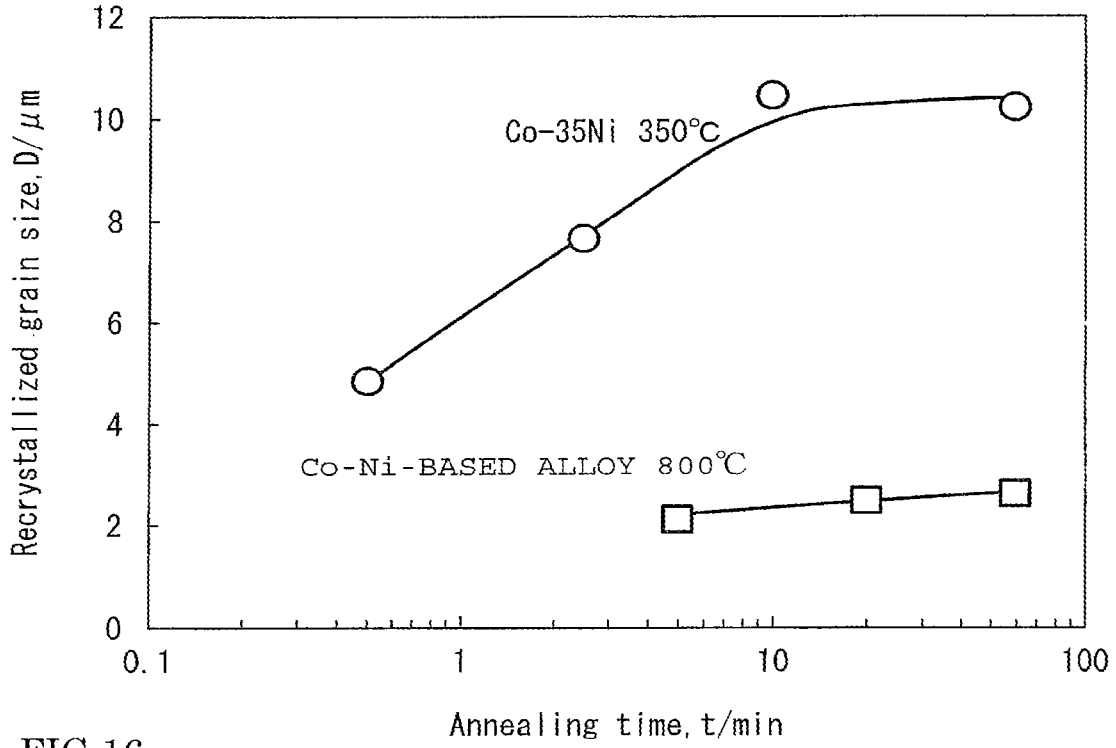
FIG. 15 is a line graph illustrating grain growth depending on the heat treatment time of an alloy in each of Example 5 and Comparative Example 5.
Figure 16:
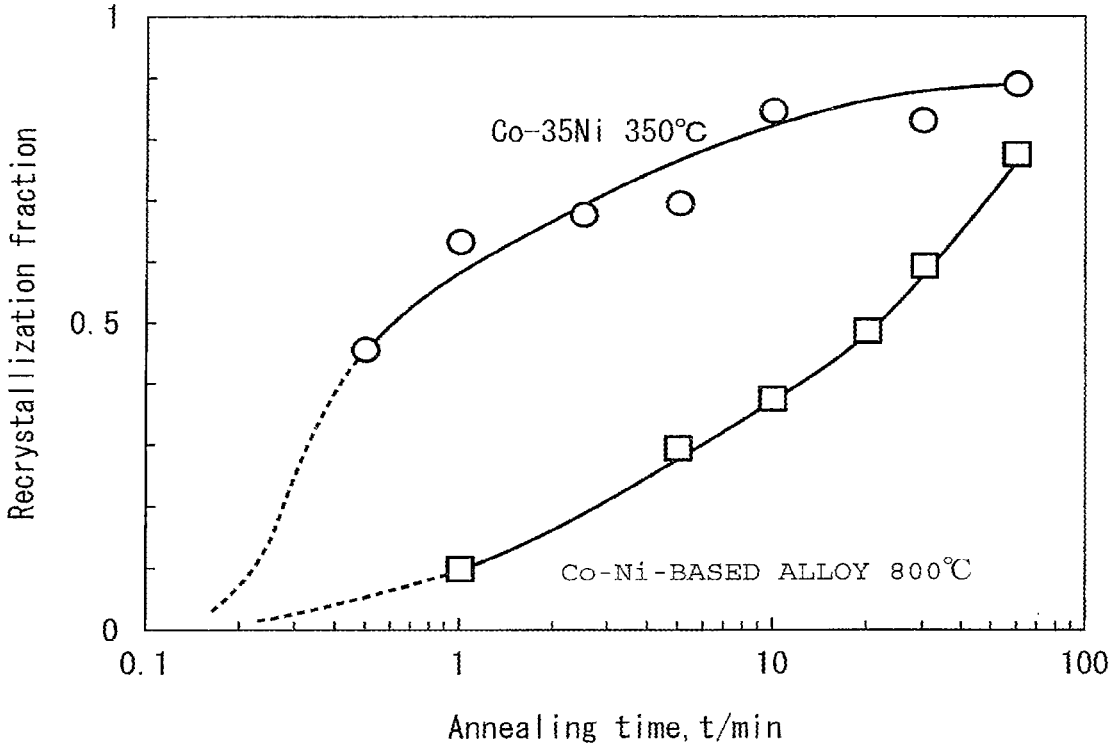
FIG. 16 is an isothermal recrystallization curve of the alloy in each of Example 5 and Comparative Example 5.

Cold rolling was applied to the alloy material for examples at a reduction ratio of 70%, thereby producing a Co—Ni-based alloy. Heat treatment at 800° C. was applied to the resultant Co—Ni-based alloy. After heat treatment at 800° C. was applied to the Co—Ni-based alloy for various heat treatment times, EBSD measurements were carried out. FIG. 15 is a graph prepared by plotting, with respect to the heat treatment times, the average diameters of recrystallized grains determined based on the results of the EBSD measurements. Further, FIG. 16 is a graph prepared by plotting, with respect to the heat treatment times, the fractions of a recrystallization region determined based on the results of the EBSD measurements. Further, FIG. 17A shows kernel average misorientation (KAM) images by EBSD of the Co—Ni-based alloys to which heat treatment at 800° C. was performed for treatment times of 5 minutes, 20 minutes, and 60 minutes.

Comparative Example 5

Cold rolling was applied to the alloy material for comparative examples at a reduction ratio of 70%, thereby producing a Co-35Ni alloy. Heat treatment at 350° C. was applied to the resultant Co-35Ni alloy. After heat treatment at 350° C. was applied to the Co-35Ni alloy for various heat treatment times, EBSD measurements were carried out. FIG. 15 plots, with respect to the heat treatment times, the average diameters of recrystallized grains determined based on the results of the EBSD measurements. Further, FIG. 16 plots, with respect to the heat treatment times, the fractions of a recrystallization region determined based on the results of the EBSD measurements. Further, FIG. 17B shows KAM images by EBSD of the Co-35Ni alloys to which heat treatment at 350° C. was performed for treatment times of 0.5 minute, 2.5 minutes, and 60 minutes.

The results of FIG. 15, FIG. 16, and FIG. 17 show that, in the Co-35Ni alloy in Comparative Example 5, recrystallization and grain growth progressed rapidly, and recrystallized grains grew so as to each have a diameter of about 10 μm by the heat treatment at 350° C. for 60 minutes. On the other hand, in the Co—Ni-based alloy in Example 5, recrystallization and grain growth progressed slowly, the diameter of each recrystallized grain changed only slightly by changing the heat treatment time, and the diameter of the each recrystallized grain was about 2 μm even after the heat treatment at 800° C. for 60 minutes was performed. From this result, it is estimated that, in the Co—Ni-based alloy in Example 5, as illustrated in FIG. 2A, a texture in which a plurality of regions each having a low dislocation density are present in a region having a high dislocation density was formed by performing heat treatment, and recrystallized grains grew. That is, it is estimated that, in the Co—Ni-based alloy in Example 5, the Suzuki effect is expressed by heat treatment, to thereby extend dislocations, leading to the delayed recovery of the dislocations and resulting in slow grain growth.

Example 6

Figure 18:
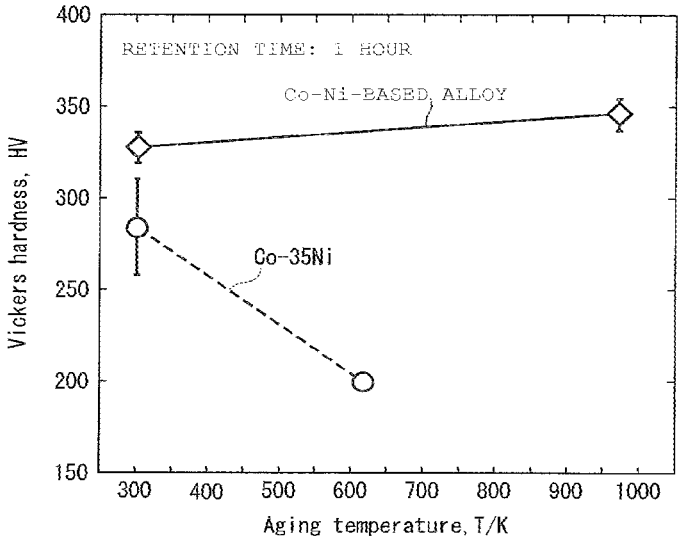
FIG. 18 is a graph illustrating a change of hardness before and after heat treatment of an alloy in each of Example 6 and Comparative Example 6.

Cold rolling was applied to the alloy material for examples at a reduction ratio of 15%, thereby producing a Co—Ni-based alloy. Heat treatment at 700° C. for 1 hour was applied to the resultant Co—Ni-based alloy. FIG. 18 is a graph prepared by plotting the hardness [HV] of the Co—Ni-based alloy before the heat treatment and the hardness [HV] of the Co—Ni-based alloy after the heat treatment. FIG. 19A is a TEM bright-field image photograph of the Co—Ni-based alloy before the heat treatment, and FIG. 19B is a TEM bright-field image photograph of the Co—Ni-based alloy after the heat treatment.

Comparative Example 6

Cold rolling was applied to the alloy material for comparative examples at a reduction ratio of 15%, thereby producing a Co-35Ni alloy. Heat treatment at 350° C. for 1 hour was applied to the resultant Co-35Ni alloy. FIG. 18 plots the hardness [HV] of the Co-35Ni alloy before the heat treatment and the hardness [HV] of the Co-35Ni alloy after the heat treatment. FIG. 19C is a TEM bright-field image photograph of the Co-35Ni alloy before the heat treatment, and FIG. 19D is a TEM bright-field image photograph of the Co-35Ni alloy after the heat treatment.

The result of FIG. 18 shows that, by applying the heat treatment at 350° C. for 1 hour to the Co-35Ni alloy in Comparative Example 6, the hardness of the alloy remarkably lowered. On the other hand, by applying the heat treatment at 700° C. for 1 hour to the Co—Ni-based alloy in Example 6, the hardness of the alloy improved. From this result, it is estimated that, in the Co—Ni-based alloy in Example 6, the Suzuki effect caused by heat treatment induced the locking of dislocations, thereby preventing easy slip of the dislocations, and resulting in the improvement of the hardness. Further, as shown in FIG. 19A and FIG. 19B, by applying the heat treatment at 700° C. for 1 hour to the Co—Ni-based alloy in Example 6, many stacking faults that look like small vertical lines occur as shown in FIG. 19B, and hence, it is found that the Suzuki effect induces the extension and locking of dislocations. In contrast, as shown in FIG. 19C and FIG. 19D, by applying the heat treatment at 350° C. for 1 hour to the Co-35Ni alloy in Comparative Example 6, dislocations that look like lines are decreased, and hence, dislocation recovery is found.

Example 7

Figure 20:
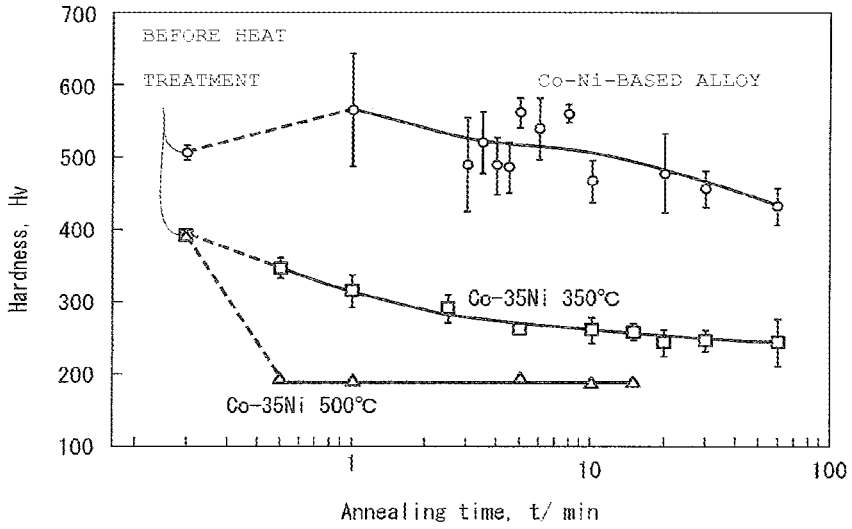
FIG. 20 is a graph prepared by plotting a change of hardness depending on a heat treatment time of an alloy in each of Example 7 and Comparative Example 7.

Cold rolling was applied to the alloy material for examples at a reduction ratio of 70%, thereby producing a Co—Ni-based alloy. Heat treatment at 800° C. was applied to the resultant Co—Ni-based alloy for various heat treatment times. Then, measurement was performed on how the hardness of the Co—Ni-based alloy changes depending on the heat treatment time. FIG. 20 plots the results of the measurement.

Comparative Example 7

Cold rolling was applied to the alloy material for comparative examples at a reduction ratio of 70%, thereby producing a Co-35Ni alloy. Heat treatment at 350° C. or 500° C. was applied to the resultant Co-35Ni alloy for various heat treatment times. Then, measurement was performed on how the hardness of the Co-35Ni alloy changes depending on the heat treatment temperature and the heat treatment time. FIG. 20 plots the results of the measurement.

The result of FIG. 20 shows that, by performing heat treatment to the Co-35Ni alloy, its hardness remarkably lowered. In contrast, in the Co—Ni-based alloy in Example 7, heat treatment at 800° C. for one minute induced the expression of the Suzuki effect, leading to the improvement of the hardness, and then, the Suzuki effect delayed dislocation recovery, resulting in a gradual change in the hardness.

Example 8

Figure 21:
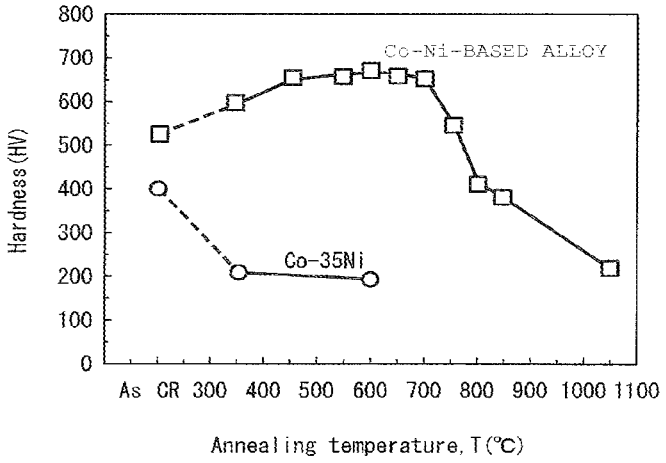
FIG. 21 is a graph prepared by plotting a change of hardness depending on a heat treatment temperature of an alloy in each of Example 8 and Comparative Example 8.

Cold rolling was applied to the alloy material for examples at a reduction ratio of 90%, thereby producing a Co—Ni-based alloy. Heat treatment for a heat treatment time of 1 hour was applied to the resultant Co—Ni-based alloy at various heat treatment temperatures ranging from 350° C. up to 1,050° C. Then, measurement was performed on how the hardness of the Co—Ni-based alloy changes depending on the heat treatment temperature. FIG. 21 plots the results of the measurement.

Comparative Example 8

Cold rolling was applied to the alloy material for comparative examples at a reduction ratio of 90%, thereby producing a Co-35Ni alloy. Heat treatment for a heat treatment time of 1 hour was applied to the resultant Co-35Ni alloy at 350° C. or 600° C. Then, measurement was performed on how the hardness of the Co-35Ni alloy changes depending on the heat treatment temperature. FIG. 21 plots the results of the measurement.

The result of FIG. 21 shows that, by performing heat treatment to the Co-35Ni alloy, its hardness remarkably lowered. In contrast, in the Co—Ni-based alloy in Example 8, heat treatment at 350° C. or more improved the hardness, and hence the heat treatment at 350° C. or more was confirmed to induce the expression of the Suzuki effect. Further, because the Suzuki effect is expressed in the early stage of heating, the heating temperature may be 1,050° C., but recrystallization becomes dominant at 800° C. or more over dislocation locking induced by the Suzuki effect, resulting in the reduction of the hardness of the Co—Ni-based alloy. Thus, the heating temperature was confirmed to be more preferably in the range of 350° C. to 750° C.

Example 9

Sample Nos. 8 to 14

Cold rolling was applied to the alloy material for examples at a reduction ratio of 90%, thereby producing each Co—Ni-based alloy of Sample Nos. 8 to 14. Heat treatment was applied to the resultant each Co—Ni-based alloy under the heat treatment conditions listed in Table 3. X-ray diffraction measurement, texture observation, and measurement of dynamic characteristics were carried out on the each Co—Ni-based alloy after the heat treatment. The resultant results were also listed in Table 3. Note that in Table 3, determination by EBSD (electron backscatter diffraction) was made based on the criteria in which observable cases are each represented by Symbol "○" and unobservable cases are each represented by Symbol "x."

TABLE 3

| | | XRD data | | Texture observation | | | Dynamic characteristics | | | | | |
|---|---|---|---|---|---|---|---|---|---|---|---|---|
| Sample No. | Heat treatment | Crystal structure | Crystal texture | TEM | EBSD | Optical microscope | Hardness [HV] | 0.2% proof stress [Mpa] | UTS [Mpa] | Elongation [%] | RD//E [Gpa] | TD//E [Gpa] |
| 8 | — | γ | Goss | Strain-induced crystal grain refinement | x | Crystal grains extending in RD | 533 | 2,000 | 2,115 | 6.55 | 183 | 236 |
| 9 | 650° C., 1 h | γ | Goss | — | — | Crystal grains extending in RD | 661 | 2,524 | 2,600 | 0.44 | 208 | 260 |
| 10 | 700° C., 1 h | γ | Goss | Stacking faults | — | Crystal grains extending in RD | 649 | 2,358 | 2,415 | 0.50 | 207 | 263 |
| 11 | 750° C., 1 h | γ | Goss | — | ○ | Partial recrystallization | 548 | 1,965 | 1,989 | 3.58 | 210 | 263 |
| 12 | 800° C., 1 h | γ | Goss | Recrystallized grains and residual dislocations | ○ | Fine recrystallized grains | 409 | 1,130 | 1,365 | 26.35 | 214 | 250 |
| 13 | 850° C., 1 h | γ | Goss | — | — | — | 378 | — | — | — | 214 | 249 |
| 14 | 1,050° C., 1 h | γ | Goss | Grain growth | ○ | Grain growth | 221 | 480 | 1,030 | 61.80 | 211 | 265 |

The results of Table 3 show that, in each Co—Ni-based alloy to which heat treatment had been applied at temperature of 650° C. or more, the crystal texture included a Goss orientation as the main orientation, and the main orientation of the crystal texture before the heat treatment remained unchanged. The results also show that the heat treatment improved the dynamic characteristics.

Example 10

Sample Nos. 15 to 22

Cold rolling was applied to the alloy material for examples at a reduction ratio of 90%, thereby producing each Co—Ni-based alloy of Sample Nos. 15 to 22. Heat treatment was applied to the resultant each Co—Ni-based alloy under the heat treatment conditions listed in Table 4. X-ray diffraction measurement, texture observation, and measurement of dynamic characteristics were carried out on the each Co—Ni-based alloy after the heat treatment. The resultant results were also listed in Table 4.

TABLE 4

| | Heat | XRD data | | | | Dynamic characteristics | | | | | |
|---|---|---|---|---|---|---|---|---|---|---|---|
| Sample No. | treatment time (700° C.) | Crystal structure | Dislocation density [$m^{-2}$] | Crystal texture | Texture observation TEM | Hardness [HV] | 0.2% proof stress [Mpa] | UTS [Mpa] | Elongation [%] | RD//E [Gpa] | TD//E [Gpa] |
| 15 | — | γ | $4.49 \times 10^{16}$ | Goss | Strain-induced crystal grain refinement | 533 | 2,000 | 2,115 | 6.55 | 183 | 236 |
| 16 | 0.5 h | γ | $1.97 \times 10^{16}$ | Goss | Worked texture | 665 | 2,326 | 2,400 | 0.40 | 209 | 242 |
| 17 | 1.5 h | γ | — | Goss | — | 624 | 2,240 | 2,300 | 0.48 | 208 | 240 |
| 18 | 3.5 h | γ | — | Goss | — | 631 | 2,185 | 2,245 | 0.73 | — | 252 |
| 19 | 6.0 h | γ, μ, δ | $1.02 \times 10^{16}$ | Goss | Worked texture | 634 | — | — | — | — | 245 |

TABLE 4-continued

| Sample No. | Heat treatment time (700° C.) | XRD data: Crystal structure | XRD data: Dislocation density [$m^{-2}$] | XRD data: Crystal texture | Texture observation TEM | Dynamic characteristics: Hardness [HV] | Dynamic characteristics: 0.2% proof stress [Mpa] | Dynamic characteristics: UTS [Mpa] | Dynamic characteristics: Elongation [%] | Dynamic characteristics: RD//E [Gpa] | Dynamic characteristics: TD//E [Gpa] |
|---|---|---|---|---|---|---|---|---|---|---|---|
| 20 | 9.0 h | γ, μ, δ | — | Goss | — | 617 | 1,955 | 2,002 | 1.35 | — | 249 |
| 21 | 12.0 h | γ, μ, δ | — | Goss | Fine recrystallized grains and precipitates | 582 | 1,925 | 2,032 | 0.98 | — | 244 |
| 22 | 72.0 h | γ, μ, δ | $5.35 \times 10^{15}$ | Goss | Fine recrystallized grains and grain boundary precipitates | 497 | 1,740 | 1,851 | 2.15 | — | 239 |

The results of Table 4 show that, in each Co—Ni-based alloy to which heat treatment had been applied at temperature of 700° C. for 0.5 hour or more, the crystal texture included a Goss orientation as the main orientation, and the main orientation of the crystal texture before the heat treatment remained unchanged. The results also show that the heat treatment improved the dynamic characteristics.

What is claimed is:

1. A method of producing a Co—Ni-based alloy, consisting of the following sequential steps:

providing an ingot that includes Co, Ni, Cr, and Mo, subjecting the ingot to hot forging, followed by annealing;

cold rolling the ingot at a reduction ratio of 15% or more to provide a Co—Ni-based alloy with a crystal texture in which deformation twins are separated by fine regions and a Goss orientation is a main orientation, wherein, the fine regions are defined as high-density dislocation regions having a higher dislocation than the deformation twins and the deformation twins are defined as low-density dislocation regions having a lower dislocations than the fine regions; and, heat treating at a temperature of at least about 350° C. to 750° C. for 0.5 hour or more and 1.5 hours or less, wherein a main orientation of the crystal texture after heat treatment is identical to a main orientation of the crystal texture before heat treatment, wherein the Co—Ni-based alloy has a Cr mass ratio of 19% to 27%.

2. The method of claim 1, wherein the Co—Ni-based alloy has a composition including, in terms of mass ratio:

28 to 42% of Co, 19% of Cr, 3 to 12% of Mo, 15 to 40% of Ni, 0.1 to 1% of Ti, 1.5% or less of Mn, 0.1 to 26% of Fe, 0.1% or less of C, and an inevitable impurity; and at least one kind selected from the group consisting of 3% or less of Nb, 5% or less of W, 0.5% or less of Al, 0.1% or less of Zr, and 0.01% or less of B.

3. The method of claim 1, wherein the cold rolling is conducted at a reduction ratio of less than 90%.

4. The method of claim 1, wherein after cold rolling the Co—Ni-based alloy has a crystal texture in which a Goss orientation accounts for 35 to 55% of all orientations.

5. The method of claim 1, wherein, after heat treating, the crystal texture is converted to a texture in which a plurality of low-density dislocation regions are present in high density dislocation regions.

6. The method of claim 5, wherein, after heat treating, the alloy has a dislocation density of $10^{15}$ $m^{-2}$ or more.

* * * * *